US012474130B2

(12) United States Patent
Adachi et al.

(10) Patent No.: US 12,474,130 B2
(45) Date of Patent: Nov. 18, 2025

(54) HEAT EXCHANGER AND AIR-CONDITIONING APPARATUS

(71) Applicant: Mitsubishi Electric Corporation, Tokyo (JP)

(72) Inventors: Rihito Adachi, Tokyo (JP); Yoji Onaka, Tokyo (JP); Ryota Akaiwa, Tokyo (JP); Yohei Kato, Tokyo (JP); Yuta Sato, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 160 days.

(21) Appl. No.: 18/281,311

(22) PCT Filed: Apr. 6, 2021

(86) PCT No.: PCT/JP2021/014623
§ 371 (c)(1),
(2) Date: Sep. 11, 2023

(87) PCT Pub. No.: WO2022/215165
PCT Pub. Date: Oct. 13, 2022

(65) Prior Publication Data
US 2024/0159479 A1 May 16, 2024

(51) Int. Cl.
*F28F 9/02* (2006.01)
*F28D 1/053* (2006.01)
*F28D 21/00* (2006.01)

(52) U.S. Cl.
CPC ..... *F28F 9/026* (2013.01); *F28D 1/05366* (2013.01); *F28D 1/05391* (2013.01);
(Continued)

(58) Field of Classification Search
CPC ..... F28F 9/026; F28F 9/0263; F28F 9/0265; F28D 1/05366; F28D 1/05391; F28D 2021/0019
(Continued)

(56) References Cited

U.S. PATENT DOCUMENTS 6,062,303 A 5/2000 Ahn et al.
6,449,979 B1 * 9/2002 Nagasawa ..... F28D 1/05391 62/503
(Continued)

FOREIGN PATENT DOCUMENTS

JP H11-182977 A 7/1999
JP 2012-021679 A 2/2012
(Continued)

OTHER PUBLICATIONS

International Search Report and Written Opinion mailed on Jun. 29, 2021, received for PCT Application PCT/JP2021/014623, filed on Apr. 6, 2021, 13 pages including English Translation.
(Continued)

*Primary Examiner* — Joel M Attey
(74) *Attorney, Agent, or Firm* — XSENSUS LLP

(57) ABSTRACT

A heat exchanger includes a distributor; a plurality of heat-transfer tubes; and a refrigerant inflow pipe. The plurality of heat-transfer tubes connected to the distributor stick out into an internal space of the distributor such that when the plurality of heat-transfer tubes and a part defined as the internal space are projected on a plane perpendicular to an axial direction of the distributor, the plurality of heat-transfer tubes occupies one-half or greater of the part defined as the internal space. The distributor includes an orifice plate and dividing the internal space. The orifice plate is located above the lowest one of the plurality of heat-transfer tubes in the internal space. The orifice plate has an orifice through
(Continued)

which the upper and lower spaces communicate with each other.

11 Claims, 21 Drawing Sheets

(52) U.S. Cl.
CPC .... *F28D 2021/0019* (2013.01); *F28F 9/0263* (2013.01); *F28F 9/0265* (2013.01)

(58) Field of Classification Search
USPC ..... 165/165
See application file for complete search history.

(56) References Cited

U.S. PATENT DOCUMENTS

| | | | | |
|---|---|---|---|---|
| 7,931,073 | B2 * | 4/2011 | Gorbounov | F28D 1/05391 165/174 |
| 9,115,934 | B2 * | 8/2015 | Kopchick | F28F 9/0212 |
| 2015/0027672 | A1 | 1/2015 | Jindou et al. | |
| 2015/0053383 | A1 | 2/2015 | Citti et al. | |
| 2021/0215430 | A1 * | 7/2021 | Sugimura | F28F 9/0209 |
| 2022/0196335 | A1 * | 6/2022 | Watanabe | F28F 1/24 |
| 2022/0381515 | A1 * | 12/2022 | Akaiwa | F28F 9/0207 |

FOREIGN PATENT DOCUMENTS

| | | | |
|---|---|---|---|
| JP | 2012-032112 | A | 2/2012 |
| JP | 2013-061114 | A | 4/2013 |
| JP | 2013-217528 | A | 10/2013 |
| JP | 2015-511699 | A | 4/2015 |
| JP | 2018-162900 | A | 10/2018 |
| JP | 2019-095073 | A | 6/2019 |
| JP | 2020-070951 | A | 5/2020 |
| JP | 2020-165570 | A | 10/2020 |

OTHER PUBLICATIONS

Notice of Reasons for Refusal mailed on May 24, 2022, received for JP Application 2022-511010, 17 pages including English Translation.

Decision of Refusal mailed on Aug. 23, 2022, received for JP Application 2022-511010, 7 pages including English Translation.

* cited by examiner

HEAT EXCHANGER AND AIR-CONDITIONING APPARATUS

CROSS-REFERENCE TO RELATED APPLICATION

The present application is based on PCT filing PCT/JP2021/014623, filed Apr. 6, 2021, the entire contents of which are incorporated herein by reference.

TECHNICAL FIELD

The present disclosure relates to a heat exchanger and an air-conditioning apparatus each configured to cause refrigerant flowing in heat-transfer tubes and air to exchange heat with each other, and particularly relates to a distributor configured to supply the refrigerant to the heat-transfer tubes while dividing the refrigerant.

BACKGROUND ART

In general, heat exchangers employ a refrigerant distribution technique in which two-phase gas-liquid refrigerant is caused to flow from a distributor (header), configured to distribute the refrigerant, into a plurality of heat-transfer tubes connected to the distributor. In one disclosed example of such a heat exchanger, if the refrigerant is caused to flow horizontally in the distributor, the flow resistance is increased by a wall provided inside the distributor, aiming at even distribution of the two-phase gas-liquid refrigerant flowing into the plurality of heat-transfer tubes connected to the distributor (see Patent Literature 1). The performance of the heat exchanger depends on the amounts of liquid refrigerant flowing into the respective heat-transfer tubes (the distribution characteristic).

CITATION LIST

Patent Literature

Patent Literature 1: Japanese Unexamined Patent Application Publication No. 2012-32112

SUMMARY OF INVENTION

Technical Problem

However, if the distributor such as the one disclosed by Patent Literature 1 is vertically oriented and the two-phase gas-liquid refrigerant flows thereinto from a lower part thereof, the liquid refrigerant in the two-phase gas-liquid refrigerant flowing in the distributor is difficult to reach a downstream part (upper part) because of gravity. In particular, under a low load, the flow rate of the liquid refrigerant supplied into the heat-transfer tubes is relatively high for those heat-transfer tubes that are located in a lower part but is relatively low for those heat-transfer tubes that are located in an upper part. Therefore, if the distributor is configured such that two-phase gas-liquid refrigerant is received at a lower position and flows upward inside the distributor, the distribution of the refrigerant may become uneven among the heat-transfer tubes arranged side by side in the top-bottom direction of the distributor. Consequently, the performance of the heat exchanger may be deteriorated. The performance of such a heat exchanger can be improved by causing an increased amount of liquid refrigerant to flow into not only those heat transfer tubes that are located in a lower part but also those heat transfer tubes that are located in an upper part.

The present disclosure is to solve the above problem and to provide a heat exchanger and an air-conditioning apparatus that are excellent in the performance of evenly distributing two-phase gas-liquid refrigerant.

Solution to Problem

A heat exchanger according to one embodiment of the present disclosure includes a distributor extending in a top-bottom direction in a form of a pipe and in which refrigerant flows; a plurality of heat-transfer tubes connected to the distributor while being arranged at intervals from one another in the top-bottom direction, the heat-transfer tubes receiving the refrigerant flowing from the distributor; and a refrigerant inflow pipe connected to the distributor at a position below a lowest one of the plurality of heat-transfer tubes and through which the refrigerant flows into the distributor. The plurality of heat-transfer tubes connected to the distributor stick out into an internal space of the distributor such that when the plurality of heat-transfer tubes and a part defined as the internal space are projected on a plane perpendicular to an axial direction of the distributor, the plurality of heat-transfer tubes occupies one-half or greater of the part defined as the internal space. The distributor includes an orifice plate being in a form of a plate and dividing the internal space into an upper space and a lower space in a longitudinal direction of the distributor. The orifice plate is located above the lowest one of the plurality of heat-transfer tubes in the internal space. The orifice plate has an orifice that is a through-hole through which the upper space and the lower space communicate with each other.

An air-conditioning apparatus according to another embodiment of the present disclosure includes the heat exchanger according to the one embodiment of the present disclosure, and a fan configured to supply air to the plurality of heat-transfer tubes.

Advantageous Effects of Invention

The heat exchanger according to the one embodiment of the present disclosure includes the distributor including the orifice plate having the orifice, and the orifice plate is located above the lowest one of the plurality of heat-transfer tubes. The refrigerant gathers the flow speed thereof by passing through the orifice, so that liquid refrigerant reaches an upper part of the distributor. Therefore, in the distributor including the orifice plate, the amount of liquid refrigerant to be supplied into those heat-transfer tubes that are connected to an upper part of the distributor is greater than in a distributor including no orifice plate. Such a configuration of the distributor prevents the separation between the gas refrigerant and the liquid refrigerant contained in the two-phase gas-liquid refrigerant that may occur while the refrigerant flows upward in the distributor. Accordingly, the gas refrigerant and the liquid refrigerant are evenly distributed to those heat-transfer tubes that are located in a downstream part of the distributor.

The air-conditioning apparatus according to the other embodiment of the present disclosure includes the heat exchanger configured as above. Therefore, the separation between the gas refrigerant and the liquid refrigerant in the two-phase gas-liquid refrigerant is prevented. Accordingly, the gas refrigerant and the liquid refrigerant are evenly distributed to those heat-transfer tubes that are located in a downstream part of the distributor.

DESCRIPTION OF EMBODIMENTS

Figure 1:
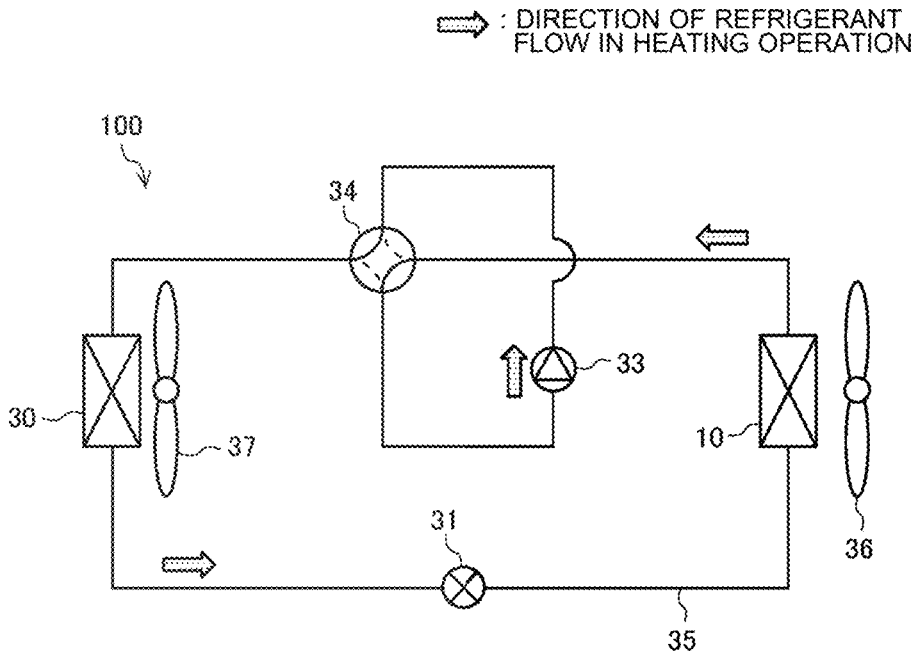
FIG. 1 illustrates a refrigerant circuit configuration of an air-conditioning apparatus according to Embodiment 1 in a heating operation.

Embodiments of the present disclosure will now be described with reference to the drawings. In the drawings including FIG. 1 to be referred to below, the same reference signs denote the same or equivalent elements, which applies throughout the description of the following embodiments. Furthermore, in each of the embodiments, elements that are the same as or equivalent to those described in any of the preceding embodiments are denoted by the same reference signs, and description thereof may be omitted. Hatching in the sectional diagrams may be omitted as appropriate in view of visibility. The forms of the individual elements described throughout this specification are only exemplary and are not limited to those described in this specification. The shapes, sizes, and locations of the elements illustrated in the drawings may be changed as appropriate within the scope of the present disclosure. Features of the following embodiments may be combined between different embodiments as long as such combinations do not cause any problem, even if no particular statement is provided.

Embodiment 1

Figure 2:
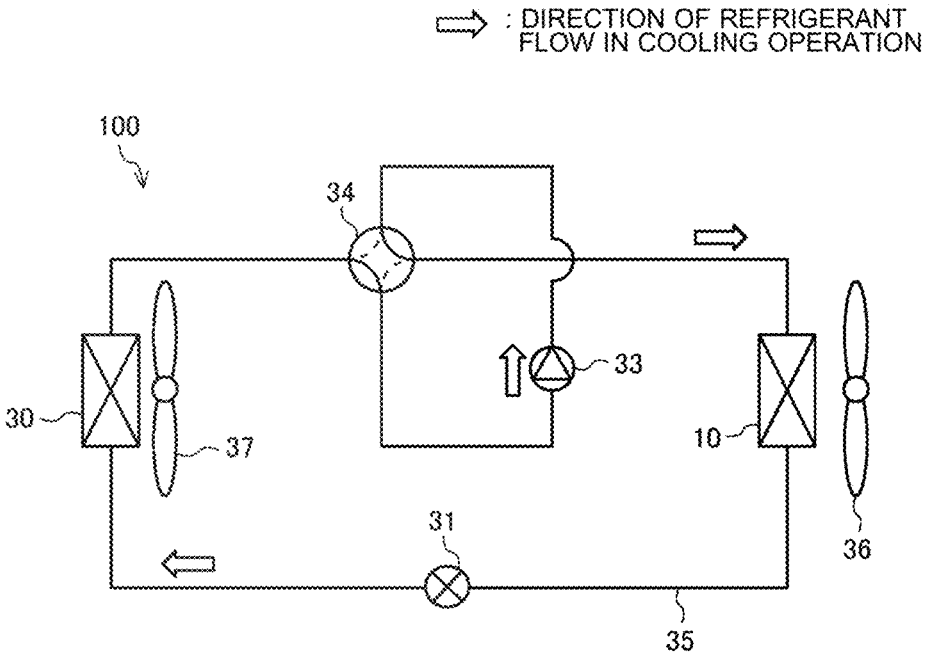
FIG. 2 illustrates a refrigerant circuit configuration of the air-conditioning apparatus according to Embodiment 1 in a cooling operation.

FIG. 1 illustrates a refrigerant circuit configuration of an air-conditioning apparatus 100 according to Embodiment 1 in a heating operation. FIG. 2 illustrates a refrigerant circuit configuration of the air-conditioning apparatus 100 according to Embodiment 1 in a cooling operation. The arrows provided in FIG. 1 represent the direction of refrigerant flow generated in the air-conditioning apparatus 100 during the heating operation. The arrows provided in FIG. 2 represent the direction of refrigerant flow generated in the air-conditioning apparatus 100 during the cooling operation.

Referring to FIGS. 1 and 2, the configuration and operations of the air-conditioning apparatus 100 will now be described. The air-conditioning apparatus 100 includes an outdoor heat exchanger 10 and an indoor heat exchanger 30, as with a room air conditioner for home use or a packaged air conditioner for store or office use. The air-conditioning apparatus 100 described herein includes one outdoor heat exchanger 10 and one indoor heat exchanger 30. Alternatively, the air-conditioning apparatus 100 may include a plurality of outdoor heat exchangers 10 and a plurality of indoor heat exchangers 30. The numbers of outdoor heat exchangers 10 and indoor heat exchangers 30 are not limited to those recognizable in FIGS. 1 and 2 and may be determined considering where the air-conditioning apparatus 100 is to be installed.

<Configuration of Air-Conditioning Apparatus 100>

The air-conditioning apparatus 100 includes an outdoor heat exchanger 10, an indoor heat exchanger 30, a compressor 33, an expansion device 31, and a flow switching device 34. Such devices are connected to one another by a refrigerant pipe 35, whereby a refrigerant circuit in which refrigerant flows is established. The air-conditioning apparatus 100 further includes an outdoor fan 36, which supplies air to the outdoor heat exchanger 10; and an indoor fan 37, which supplies air to the indoor heat exchanger 30.

The outdoor heat exchanger 10 causes the refrigerant flowing thereinside and the air supplied thereto by the outdoor fan 36 to exchange heat with each other. The outdoor heat exchanger 10 serves as an evaporator in the heating operation and as a condenser in the cooling operation. The indoor heat exchanger 30 causes the refrigerant flowing thereinside and indoor air supplied thereto by the indoor fan 37 to exchange heat with each other. The indoor heat exchanger 30 serves as a condenser in the heating operation and as an evaporator in the cooling operation.

The compressor 33 is a fluid machine that compresses the refrigerant sucked thereinto and discharges the compressed refrigerant. The expansion device 31 is, for example, an expansion valve and decompresses the refrigerant. The expansion device 31 may be an electronic expansion valve whose opening degree is adjusted under the control of a controller (not illustrated). The flow switching device 34 is, for example, a four-way valve and is controlled by the controller (not illustrated) to switch the refrigerant passageway between the one for the cooling operation of the air-conditioning apparatus 100 and the one for the heating operation of the air-conditioning apparatus 100.

<How Air-Conditioning Apparatus 100 Works in Heating Operation>

Referring to FIG. 1, how the air-conditioning apparatus 100 works in the heating operation will now be described by following the flow of the refrigerant. First, low-temperature, low-pressure gas refrigerant is sucked into the compressor 33, where the sucked refrigerant is compressed into high-temperature, high-pressure gas refrigerant. The high-temperature, high-pressure gas refrigerant resulting from the compression by the compressor 33 is discharged from the compressor 33, flows through the flow switching device 34, and then flows into the indoor heat exchanger 30. The high-temperature, high-pressure gas refrigerant having flowed into the indoor heat exchanger 30 transfers heat to the air, supplied from the indoor fan 37, by exchanging heat with the air and is thus condensed into high-temperature, high-pressure liquid refrigerant, which is discharged from the indoor heat exchanger 30.

The liquid refrigerant discharged from the indoor heat exchanger 30 is expanded and decompressed by the expansion device 31 into low-temperature, low-pressure two-phase gas-liquid refrigerant, which flows into the outdoor heat exchanger 10. The two-phase gas-liquid refrigerant having flowed into the outdoor heat exchanger 10 receives heat from outdoor air, supplied from the outdoor fan 36, by exchanging heat with the outdoor air and is thus evaporated into low-temperature, low-pressure gas refrigerant, which is discharged from the outdoor heat exchanger 10. The low-temperature, low-pressure gas refrigerant discharged from the outdoor heat exchanger 10 is sucked into the compressor 33 again, where the gas refrigerant is compressed again and is discharged. The air-conditioning apparatus 100 repeatedly causes the refrigerant to circulate as above, thereby performing the heating operation of heating the indoor air.

<How Air-Conditioning Apparatus 100 Works in Cooling Operation>

Referring to FIG. 2, how the air-conditioning apparatus 100 works in the cooling operation will now be described by following the flow of the refrigerant. First, low-temperature, low-pressure gas refrigerant is sucked into the compressor 33, where the sucked refrigerant is compressed into high-temperature, high-pressure gas refrigerant. The high-temperature, high-pressure gas refrigerant resulting from the compression by the compressor 33 is discharged from the compressor 33, flows through the flow switching device 34, and then flows into the outdoor heat exchanger 10. The high-temperature, high-pressure gas refrigerant having flowed into the outdoor heat exchanger 10 transfers heat to the air, supplied from the outdoor fan 36, by exchanging heat with the air and is thus condensed into high-temperature, high-pressure liquid refrigerant, which is discharged from the outdoor heat exchanger 10.

The liquid refrigerant discharged from the outdoor heat exchanger 10 is expanded and decompressed by the expansion device 31 into low-temperature, low-pressure two-phase gas-liquid refrigerant, which flows into the indoor heat exchanger 30. The two-phase gas-liquid refrigerant having flowed into the indoor heat exchanger 30 receives heat from outdoor air, supplied from the indoor fan 37, by exchanging heat with the outdoor air and is thus evaporated into low-temperature, low-pressure gas refrigerant, which is discharged from the indoor heat exchanger 30. The low-temperature, low-pressure gas refrigerant discharged from the indoor heat exchanger 30 is sucked into the compressor 33 again, where the gas refrigerant is compressed again and is discharged. The air-conditioning apparatus 100 repeatedly causes the refrigerant to circulate as above, thereby performing the cooling operation of cooling the indoor air.

<Outdoor Heat Exchanger 10>

Figure 3:
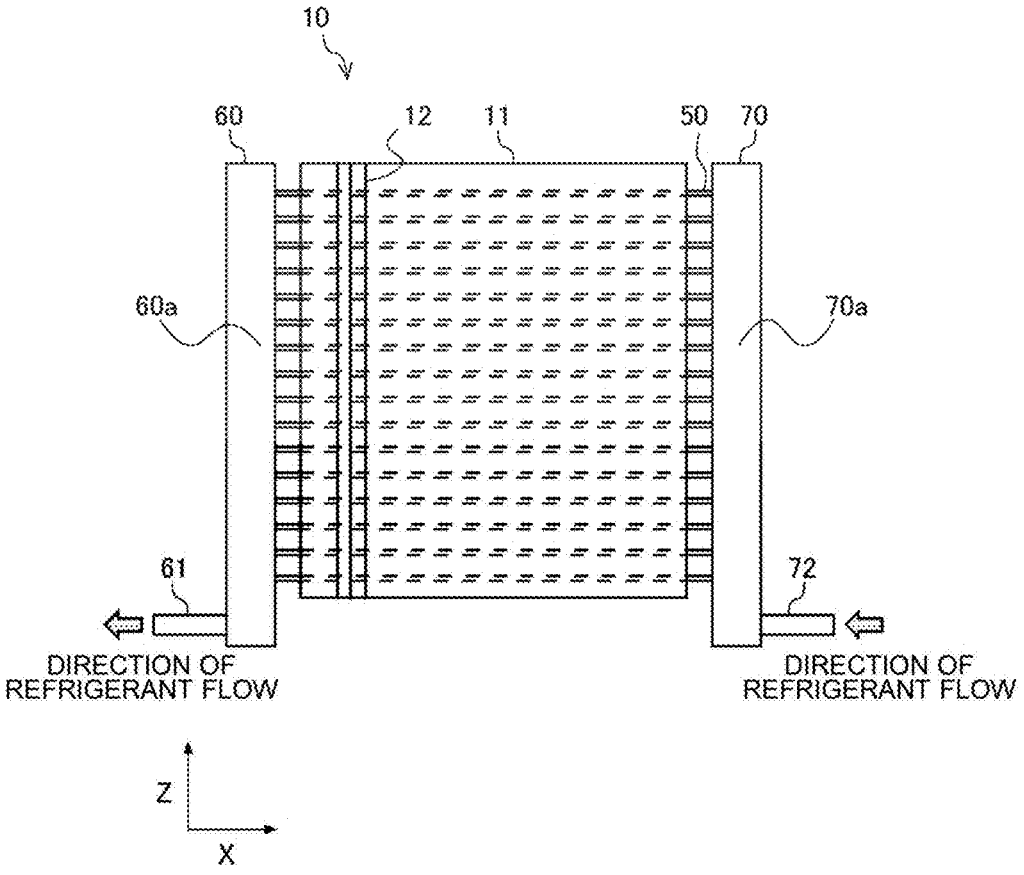
FIG. 3 schematically illustrates a configuration of an outdoor heat exchanger according to Embodiment 1.

FIG. 3 schematically illustrates a configuration of the outdoor heat exchanger 10 according to Embodiment 1. The arrows provided in FIG. 3 represent the direction of refrigerant flow. Referring now to FIG. 3, the outdoor heat exchanger 10 according to Embodiment 1 will be described. In the following description, the outdoor heat exchanger 10 is regarded as a heat exchanger operating as an evaporator in the air-conditioning apparatus 100 performing the heating operation.

Note that the outdoor heat exchanger 10 may operate as a condenser in the cooling operation. When the outdoor heat exchanger 10 operates as a condenser, the direction of refrigerant flow illustrated in FIG. 3 is reversed. The configuration of the heat exchanger to be described below as the outdoor heat exchanger 10 may be replaced with the configuration of the indoor heat exchanger 30. The outdoor heat exchanger 10 and the indoor heat exchanger 30 are each also simply referred to as heat exchanger.

As illustrated in FIG. 3, the outdoor heat exchanger 10 includes a heat-exchanger core 11, a liquid-header distributor 70, and a gas-header distributor 60. The liquid-header distributor 70 and the gas-header distributor 60 may each be referred to as header.

<Heat-Exchanger Core 11>

The heat-exchanger core 11 is configured to cause air around the heat-exchanger core 11 and the refrigerant flowing in the heat-exchanger core 11 to exchange heat with each other. The heat-exchanger core 11 is located between the liquid-header distributor 70 and the gas-header distributor 60. The heat-exchanger core 11 includes a plurality of heat-transfer tubes 50, which extend in a first direction (X-axis direction) and connect the liquid-header distributor 70 and the gas-header distributor 60 to each other; and a heat-transfer promoter 12, which connect together the heat-transfer tubes 50 that are adjacent to one another.

In the heat-exchanger core 11, each of the plurality of heat-transfer tubes 50 extends between the liquid-header distributor 70 and the gas-header distributor 60. Each of the plurality of heat-transfer tubes 50 is in the form of a tube and allows the refrigerant to flow thereinside. The heat-transfer tube 50 allows the refrigerant inside the heat-transfer tube 50 and the air outside the heat-transfer tube 50 to exchange heat with each other. In the first direction (X-axis direction), each of the plurality of heat-transfer tubes 50 is connected at one end thereof to the gas-header distributor 60 and at the other end thereof to the liquid-header distributor 70.

The plurality of heat-transfer tubes 50 are arranged at intervals from one another and in parallel with one another in the axial direction (Z-axis direction), that is, the elongated direction of the liquid-header distributor 70. The plurality of heat-transfer tubes 50 are arranged at intervals from one another in the top-bottom direction. In other words, the plurality of heat-transfer tubes 50 are arranged at intervals from one another in a refrigerant-flow direction coinciding with the longitudinal direction of the liquid-header distributor 70 and the gas-header distributor 60, and are each connected to the liquid-header distributor 70 and to the gas-header distributor 60. Adjacent ones of the plurality of heat-transfer tubes 50 are oriented face to face with each other. Between each adjacent two of the plurality of heat-transfer tubes 50 is provided a gap serving as an air passageway.

In the outdoor heat exchanger 10, the elongated direction of the plurality of heat-transfer tubes 50 is referred to as the first direction and is a horizontal direction. Note that the elongated direction of the plurality of heat-transfer tubes 50 that is referred to as the first direction is not limited to a horizontal direction and may be a direction inclined relative to the horizontal direction. In the outdoor heat exchanger 10, the direction of arrangement of the plurality of heat-transfer tubes 50 is referred to as a second direction and is the vertical direction. Note that the direction of arrangement of the plurality of heat-transfer tubes 50 is not limited to the vertical direction and may be a direction inclined relative to the vertical direction.

The heat-transfer tubes 50 are each, for example, a circular tube forming a passageway having a circular cross section, or a tube forming a passageway having an oval cross section. Alternatively, the heat-transfer tubes 50 may each be a flat tube forming a passageway having a flat cross section, and the passageway provided thereinside includes a plurality of passageways. The heat-transfer tubes 50 illustrated in FIG. 3 are linear heat-transfer tubes 50 each having no U-shaped folded portion, that is, a portion where the refrigerant passageway is folded to extend in a direction other than the horizontal direction. The heat-transfer tubes 50 are not limited to such linear heat-transfer tubes 50 and may each have a U-shaped folded portion where the refrigerant passageway is folded to extend in a direction other than the horizontal direction.

The heat-exchanger core 11 may include one or more rows of stacked heat-transfer tubes 50 in a horizontal direction. The horizontal direction is orthogonal to the direction in which the heat-transfer tubes 50 extends. In other words, there may be rows of the heat-transfer tubes 50 stack in the Y-axis direction (not illustrated) that is orthogonal both to the X-axis direction and the Z-axis direction indicated in FIG. 3.

The heat-transfer promoter 12 is intended to improve the efficiency of heat exchange between the air and the refrigerant. The plurality of heat-transfer tubes 50 that are adjacent to one another are connected to one another by the heat-transfer promoter 12. The heat-transfer promoter 12 is, for example, one or more members in the form of plates. The heat-transfer promoter 12 is, for example, a plate fin or a corrugated fin. The shape of the heat-transfer promoter 12 is not limited and may be a flat shape or a corrugated shape.

The heat-exchanger core 11 includes a plurality of heat-transfer promoters 12 arranged at intervals from one another and in parallel with one another in the elongated direction of the heat-transfer tubes 50 (the X-axis direction). If the heat-transfer promoters 12 are plate fins, each of the plurality of heat-transfer tubes 50 extends through the plurality of heat-transfer promoters 12.

The heat-exchanger core 11 is not limited to the one including the heat-transfer tubes 50 and the heat-transfer promoter 12. For example, the heat-exchanger core 11 may include a plurality of heat-transfer tubes 50 but no heat-transfer promoter 12 that connects the adjacent heat-transfer tubes 50 to one another.

<Gas-Header Distributor 60>

The gas-header distributor 60 is connected to the ends of the plurality of heat-transfer tubes 50 on one side in the elongated direction (X-axis direction). The gas-header distributor 60 is connected to the heat-transfer tubes 50 of the heat-exchanger core 11 such that the inside of the gas-header distributor 60 communicates with the inside of each of the heat-transfer tubes 50. The gas-header distributor 60 extends in the direction of arrangement of the plurality of heat-transfer tubes 50 (the Z-axis direction).

In the outdoor heat exchanger 10, the gas-header distributor 60 serves as a merging mechanism where portions of the refrigerant that are discharged from the plurality of heat-transfer tubes 50 of the heat-exchanger core 11 merge together. When the outdoor heat exchanger 10 operates as an evaporator, a flow of gas-phase refrigerant occurs in the gas-header distributor 60. Specifically, the gas-header distributor 60 allows gas-phase refrigerant to flow from the upper side toward the lower side.

The gas-header distributor 60 includes a body **60*a*, to which the heat-transfer tubes 50 are connected; and a gas-header inflow/outflow pipe 61, which is connected to the body 60*a*. The body 60*a* is a long cylindrical member having two closed ends, with a space provided thereinside. The body 60*a* is formed of a pipe that is thicker than the heat-transfer tubes 50. The gas-header distributor 60 is installed such that the center axis thereof in the longitudinal direction (Z-axis direction) extends in the vertical direction or is inclined within such an angle as to have a vertical vector component. The body 60***a* has thereinside a space through which the refrigerant is to flow.

The gas-header inflow/outflow pipe 61 is intended to allow the refrigerant discharged from the plurality of heat-transfer tubes 50 and merged together to be discharge from the outdoor heat exchanger 10. The gas-header inflow/outflow pipe 61 is horizontally connected to the body 60*a* of the gas-header distributor 60. Alternatively, the gas-header inflow/outflow pipe 61 may be vertically connected to the body 60*a* of the gas-header distributor 60. Moreover, the gas-header inflow/outflow pipe 61 may be connected to the body 60*a* of the gas-header distributor 60 in a direction toward the far side or near side of the plane of the page or in any other direction. While FIG. 3 illustrates a case where one gas-header inflow/outflow pipe 61 is connected to the body 60*a* of the gas-header distributor 60, the number of gas-header inflow/outflow pipes 61 to be connected to the body 60*a* is not limited to one and may be two or more.

<Liquid-Header Distributor 70>

The liquid-header distributor 70 allows refrigerant to flow thereinside. The liquid-header distributor 70 is in the form of a long pipe elongated in the top-bottom direction. The liquid-header distributor 70 is connected to the ends of the plurality of heat-transfer tubes 50 on the other side in the elongated direction (X-axis direction). The liquid-header distributor 70 is located across the plurality of heat-transfer tubes 50 from the gas-header distributor 60. The liquid-header distributor 70 is connected to the heat-transfer tubes 50 of the heat-exchanger core 11 such that the inside of the liquid-header distributor 70 communicates with the inside of each of the heat-transfer tubes 50. The liquid-header distributor 70 extends in the direction of arrangement of the plurality of heat-transfer tubes 50 (the Z-axis direction).

The liquid-header distributor 70 distributes the refrigerant to the plurality of heat-transfer tubes 50. In the outdoor heat exchanger 10, the liquid-header distributor 70 serve as a distributing mechanism through which the refrigerant to be received by the heat-exchanger core 11 is distributed among the plurality of heat-transfer tubes 50. When the outdoor heat exchanger 10 operates as an evaporator, an upward flow of two-phase gas-liquid refrigerant occurs in the liquid-header distributor 70. Specifically, the liquid-header distributor 70 allows two-phase gas-liquid refrigerant to flow from the lower side toward the upper side. When the outdoor heat exchanger 10 operates as an evaporator, the two-phase gas-liquid refrigerant passes through an orifice 73 from the lower side toward the upper side.

The liquid-header distributor 70 is installed such that the center axis thereof in the longitudinal direction (Z-axis direction) extends in the vertical direction or is inclined within such an angle as to have a vertical vector component. The liquid-header distributor 70 includes a body 70*a*, to which the heat-transfer tubes 50 are connected; and a liquid-header inflow/outflow pipe 72, which is connected to the body 70*a*, Details of the liquid-header distributor 70 will be described separately below.

<Exemplary Operation of Outdoor Heat Exchanger 10>

An operation of the outdoor heat exchanger 10 according to Embodiment 1 will now be described, by taking an exemplary case where the outdoor heat exchanger 10 serves as an evaporator of the air-conditioning apparatus 100. The outdoor heat exchanger 10 serving as an evaporator receives the two-phase gas-liquid refrigerant resulting from the decompression by the expansion device 31. The two-phase gas-liquid refrigerant received by the outdoor heat exchanger 10 flows through the inside of the body 70*a* of the liquid-header distributor 70 in the longitudinal direction of the body 70*a* and is sequentially distributed to the plurality of heat-transfer tubes 50.

The liquid-header distributor 70 mainly distributes the two-phase gas-liquid refrigerant, which contains liquid, to the plurality of heat-transfer tubes 50. In this process, the refrigerant flowing from the liquid-header distributor 70 of the outdoor heat exchanger 10 into the plurality of heat-transfer tubes 50 receives heat while flowing through the passageways provided in the plurality of heat-transfer tubes 50 and thus evaporates. Portions of the gas-phase refrigerant resulting from the evaporation occurred in the plurality of heat-transfer tubes 50 merge together in the gas-header distributor 60. The merged gas-phase refrigerant is discharged from the gas-header distributor 60 through the gas-header inflow/outflow pipe 61, and is sucked into the compressor 33 via the flow switching device 34.

<Details of Liquid-Header Distributor 70>

Figure 4:
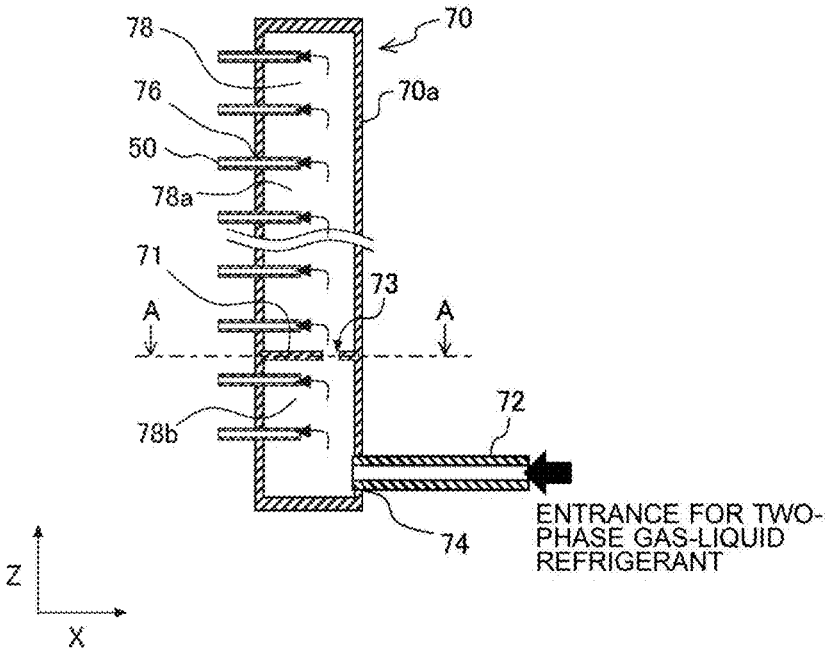
FIG. 4 outlines a liquid-header distributor according to Embodiment 1.
Figure 5:
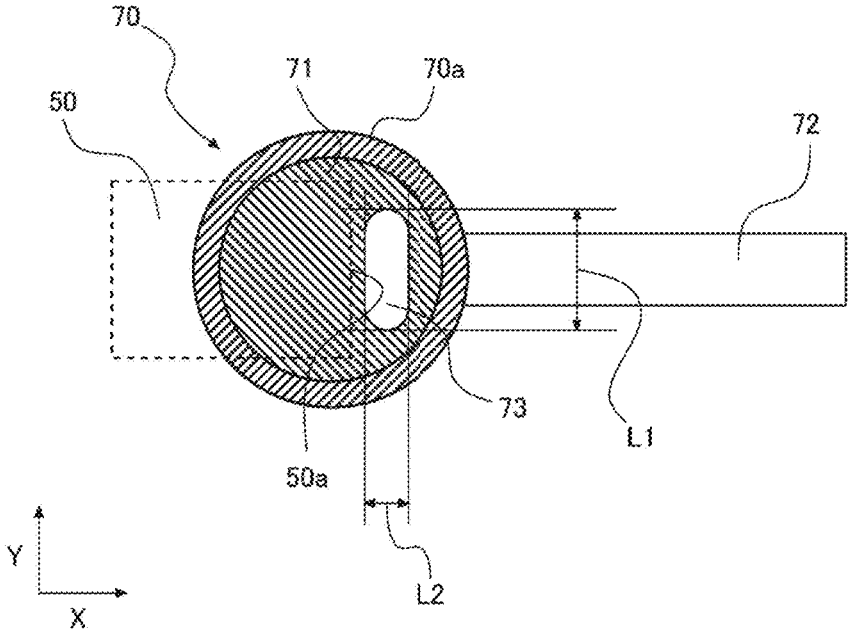
FIG. 5 illustrates a section of the liquid-header distributor illustrated in FIG. 4, taken along line A-A perpendicular to a direction in which a body thereof extends.

FIG. 4 outlines the liquid-header distributor 70 according to Embodiment 1. FIG. 5 illustrates a section of the liquid-header distributor 70 illustrated in FIG. 4, taken along line A-A perpendicular to the direction in which the body 70*a* thereof extends. The section taken along line A-A is a plane perpendicular to the axial direction of the liquid-header distributor 70. The section taken along line A-A is also regarded as a diagram illustrating a projection of the plurality of heat-transfer tubes 50 and a projection of an internal space 78, to be described below, that are obtained by projecting the plurality of heat-transfer tubes 50 and a part defined as the internal space 78 onto a plane perpendicular to the axial direction of the liquid-header distributor 70.

In FIG. 4, the X-axis direction is the direction in which the heat-transfer tubes 50 extend, and the Z-axis direction is the direction in which the body 70*a* of the liquid-header distributor 70 extends. The Z-axis direction is also regarded as the direction of arrangement of the heat-transfer tubes 50. In FIG. 5, the Y-axis direction is a direction perpendicular to the X-axis direction and to the Z-axis direction. Referring to FIGS. 4 and 5, the liquid-header distributor 70 will further be described. The liquid-header distributor 70 includes the body 70*a* and the liquid-header inflow/outflow pipe 72 attached to the body 70*a* as described above, and further includes an orifice plate 71.

<Body 70*a*>

The body 70*a* is a long cylindrical member having two closed ends, with a space through which refrigerant is to flow provided thereinside. The body 70*a* is formed of a pipe that is thicker than the heat-transfer tubes 50. While the body 70*a* of the liquid-header distributor 70 illustrated in FIG. 5 has a circular shape in a section perpendicular to the longitudinal direction thereof, the shape of the section of the body 70*a* is not limited to a circular shape and may be an oval or rectangular shape. The shape of the section of the body 70*a* is not limited to a particular shape.

The body 70*a* may have an appearance of a circular column or a polygonal column. The body 70*a* is installed such that the center axis thereof in the longitudinal direction (Z-axis direction) extends in the vertical direction or is inclined within such an angle as to have a vertical vector component. The body 70*a* has an inlet 74, connection ports 76, and the internal space 78.

The inlet 74 is a through-hole provided in the body 70*a*. The inlet 74 receives the liquid-header inflow/outflow pipe 72 connected thereto. The refrigerant flowing from the liquid-header inflow/outflow pipe 72 flows into the inlet 74.

As illustrated in FIG. 5, for example, the liquid-header inflow/outflow pipe 72 is connected to a part of the lateral face of the body 70*a* that is located opposite a part to which the heat-transfer tubes 50 are connected. The position of the inlet 74 and the position of connection of the liquid-header inflow/outflow pipe 72 are not limited to the part of the lateral face of the body 70*a* that is opposite the part to which the heat-transfer tubes 50 are connected.

As illustrated in FIG. 4, the inlet 74 is located below one of the plurality of heat-transfer tubes 50 that is at the lowest position in the body 70*a*. The position of the inlet 74 is not limited to the above. The inlet 74 may be provided face to face with the one of the plurality of heat-transfer tubes 50 that is at the lowest position in the body 70*a*.

The connection ports 76 are a plurality of through-holes provided in the body 70*a* and are arrayed in the longitudinal direction of the body 70*a* (the Z-axis direction). The plurality of connection ports 76 provided in the body 70*a* are arranged at intervals from one another in the top-bottom direction and receive the plurality of heat-transfer tubes 50 that are fitted thereto. The heat-transfer tubes 50 fitted to the connection ports 76 pierce through the wall of the body 70*a*. The heat-transfer tubes 50 fitted to the connection ports 76 are held by the lateral wall of the body 70*a*.

The plurality of heat-transfer tubes 50 connected to the body 70*a* of the liquid-header distributor 70 each have an end 50*a*, which sticks out into the internal space 78 of the liquid-header distributor 70. Now, assume that the part of the liquid-header distributor 70 that is defined as the internal space 78 and the plurality of heat-transfer tubes 50 are projected on a plane perpendicular to the axial direction of the liquid-header distributor 70. The heat-transfer tubes 50 connected to the body 70*a* stick out into the internal space 78 of the liquid-header distributor 70 such that the area of projection of the heat-transfer tubes 50 is equal to or greater than half the area of projection of the part of the liquid-header distributor 70 that is defined as the internal space 78. In other words, when the part of the liquid-header distributor 70 that is defined as the internal space 78 and the plurality of heat-transfer tubes 50 are projected on a plane perpendicular to the axial direction of the liquid-header distributor 70, the plurality of heat-transfer tubes 50 occupies one-half or greater of the part defined as the internal space 78.

The internal space 78 communicates with the spaces inside the heat-transfer tubes 50 and with the space inside the liquid-header inflow/outflow pipe 72, so that the refrigerant flowing from the liquid-header inflow/outflow pipe 72 through the inlet 74 flows upward in the internal space 78.

<Liquid-Header Inflow/Outflow Pipe 72>

The body 70*a* is provided with the liquid-header inflow/outflow pipe 72. The liquid-header inflow/outflow pipe 72 serves a refrigerant inflow pipe through which the refrigerant flows into the liquid-header distributor 70. The liquid-header inflow/outflow pipe 72 communicates with the internal space 78 of the body 70*a*, The liquid-header inflow/outflow pipe 72 is intended to allow the refrigerant to be distributed to the plurality of heat-transfer tubes 50 to flow into the outdoor heat exchanger 10. When the outdoor heat exchanger 10 serves as an evaporator, the two-phase gas-liquid refrigerant to be received by the internal space 78 of the body 70*a* flows from the outside of the outdoor heat exchanger 10 into the internal space 78 of the body 70*a* through the liquid-header inflow/outflow pipe 72.

The liquid-header inflow/outflow pipe 72 is connected to the liquid-header distributor 70 at a position below the lowest one of the plurality of heat-transfer tubes 50. Desirably, the liquid-header inflow/outflow pipe 72 may be provided at such a position as to allow the two-phase gas-liquid refrigerant to flow into a space below the lowest one of the heat-transfer tubes 50 and in such a manner as to extend in the direction in which the heat-transfer tubes 50 extend (the X-axis direction). The position of connection of the liquid-header inflow/outflow pipe 72 is not limited to the above. For example, the liquid-header inflow/outflow pipe 72 may be positioned face to face with the lowest one of the heat-transfer tubes 50 in the internal space 78.

If the liquid-header inflow/outflow pipe 72 is provided at a position between adjacent ones of the heat-transfer tubes 50 in the internal space 78, an upward refrigerant flow and a downward refrigerant flow are generated, with the speed of the upward flow of the two-phase gas-liquid refrigerant being reduced. Such a reduction in the speed of the upward flow of the two-phase gas-liquid refrigerant increases the probability of separation between the gas refrigerant and the liquid refrigerant. Therefore, the liquid-header inflow/outflow pipe 72 may desirably be provided at the position defined above.

While FIG. 4 illustrates a case where the liquid-header inflow/outflow pipe 72 is horizontally connected to the body 70*a* of the liquid-header distributor 70, the liquid-header inflow/outflow pipe 72 may be vertically connected to the body 70*a* of the liquid-header distributor 70. Moreover, the liquid-header inflow/outflow pipe 72 may be connected to the body 70*a* of the liquid-header distributor 70 in a direction toward the far side or near side of the plane of the page or in any other direction. While FIG. 4 illustrates a case where one liquid-header inflow/outflow pipe 72 is connected to the body 70*a* of the liquid-header distributor 70, the number of liquid-header inflow/outflow pipes 72 to be connected to the body 70*a* is not limited to one and may be two or more.

<Orifice Plate 71>

The liquid-header distributor 70 includes an orifice plate 71, which is in the form of a plate and is provided inside the body 70*a*. The orifice plate 71 is a partition that divides the internal space 78 of the body 70*a* in the top-bottom direction (Z-axis direction). The liquid-header distributor 70 includes one or more orifice plates 71 in an area above one of the heat-transfer tubes 50 that is closest to the liquid-header inflow/outflow pipe 72. In short, the orifice plate 71 is located above the lowest one of the plurality of heat-transfer tubes 50 in the internal space 78.

More specifically, letting the number of heat-transfer tubes 50 arranged in parallel with one another in the top-bottom direction be n, the orifice plate 71 is located below an n/2-th one of the heat-transfer tubes 50 counting from the bottom.

The body 70*a* is provided with the orifice plate 71 in the internal space 78 thereof. The internal space 78 is divided by the orifice plate 71 into a top space 78*a* and a bottom space 78*b*. In the internal space 78 of the body 70*a*, the top space 78*a* is a space above the orifice plate 71, and the bottom space 78*b* is a space below the orifice plate 71.

As illustrated in FIG. 5, the orifice plate 71 has an orifice 73. The orifice 73 is a through-hole provided in the orifice plate 71 and through which the spaces above and below the orifice plate 71 communicate with each other. The opening area of the orifice 73 is smaller than the sectional area of the internal space 78 in a plane perpendicular to the axial direction of the liquid-header distributor 70.

The orifice 73 is provided at such a position that when the orifice 73 and the plurality of heat-transfer tubes 50 are projected on a plane perpendicular to the axial direction of the liquid-header distributor 70, one-half or greater of the opening area of the orifice 73 does not coincide with the plurality of heat-transfer tubes 50. Alternatively, the orifice 73 is provided at such a position that when the orifice 73 and the plurality of heat-transfer tubes 50 are projected on a plane perpendicular to the axial direction of the liquid-header distributor 70, the orifice 73 does not coincide with the plurality of heat-transfer tubes 50.

As illustrated in FIG. 5, in a plane perpendicular to the axial direction of the liquid-header distributor 70, the orifice 73 may be shaped as an oblong hole, a slit, or any other opening that is elongated in the longitudinal direction of the end 50*a* of each flat heat-transfer tube 50. The longitudinal direction of the end 50*a* of the heat-transfer tube 50 is, for example, a horizontal direction (the Y-axis direction) orthogonal to the direction in which the heat-transfer tube 50 extends. The orifice 73 may be one of two or more holes arranged side by side at intervals in the longitudinal direction of the end 50*a* of the heat-transfer tube 50.

In a part where the heat-transfer tube 50 is fitted to the liquid-header distributor 70, the sectional shape of an area where the refrigerant passes is elongated in the longitudinal direction of the end 50*a* of the heat-transfer tube 50. Therefore, in a plane perpendicular to the axial direction of the liquid-header distributor 70, the orifice 73 may desirably be shaped such that an opening length L1, defined in a direction perpendicular to the direction in which the heat-transfer tube 50 extends, is substantially greater than an opening length L2, defined in the direction in which the heat-transfer tube 50 extends.

In the internal space 78 of the body 70*a*, the top space 78*a* and the bottom space 78*b* communicate with each other through the orifice 73 provided in the orifice plate 71. In the body 70*a*, the refrigerant flows through the orifice 73 provided in the orifice plate 71. When the outdoor heat exchanger 10 operates as an evaporator, the two-phase gas-liquid refrigerant flows through the orifice 73 from the lower side toward the upper side, that is, the two-phase gas-liquid refrigerant moves from the bottom space 78*b* to the top space 78*a* through the orifice 73.

<Functional Effects of Outdoor Heat Exchanger 10>

The liquid-header distributor 70 includes one or more orifice plates 71 in an area above one of the heat-transfer tubes 50 that is closest to the liquid-header inflow/outflow pipe 72. Each orifice plate 71 has the orifice 73. In the outdoor heat exchanger 10 configured as above, the two-phase gas-liquid refrigerant is evenly distributed from the liquid-header distributor 70 sequentially to the plurality of heat-transfer tubes 50. Such a functional effect produced by the outdoor heat exchanger 10 will now be described in detail.

Figure 6:
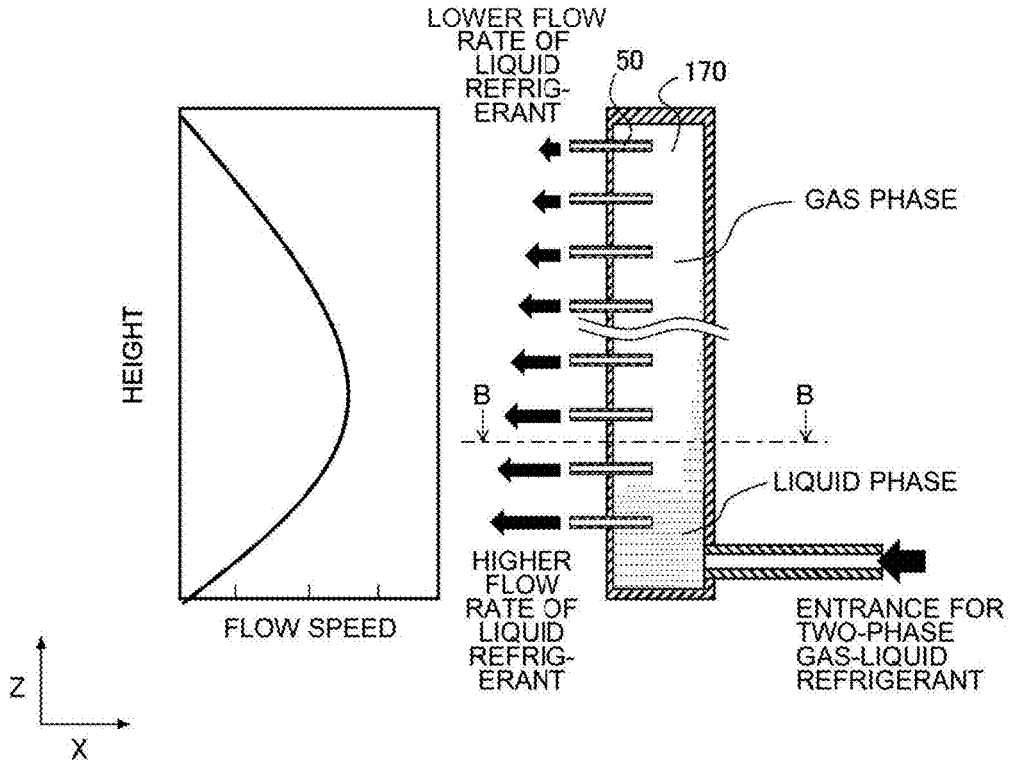
FIG. 6 schematically illustrates a liquid-header distributor according to Comparative Embodiment that includes no orifice plate thereinside, and specifically illustrates how two-phase gas-liquid refrigerant flows in the liquid-header distributor when the outdoor heat exchanger operates as an evaporator.
Figure 7:
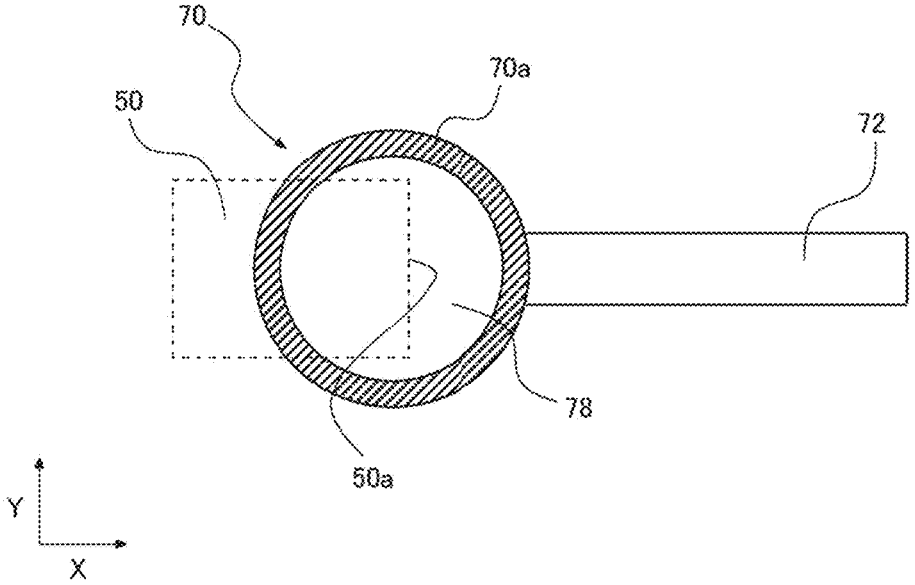
FIG. 7 conceptually illustrates a section of the liquid-header distributor illustrated in FIG. 6, taken along line B-B perpendicular to a direction in which the liquid-header distributor extends.

FIG. 6 schematically illustrates a liquid-header distributor 170 according to Comparative Embodiment, which includes no orifice plate 71 thereinside, and specifically illustrates how two-phase gas-liquid refrigerant flows in the liquid-header distributor 170 when the outdoor heat exchanger 10 operates as an evaporator. FIG. 7 conceptually illustrates a section of the liquid-header distributor 170 illustrated in FIG. 6, taken along line B-B perpendicular to a direction in which the liquid-header distributor 170 extends.

In FIG. 6, the chart to the left of the liquid-header distributor 170 illustrates the flow-speed distribution versus the height of a lateral-blow housing, such as the one with the liquid-header distributor 170, The lateral-blow housing refers to a heat exchanger in which air flows in a horizontal direction (the Y-axis direction) orthogonal to the direction in which the heat-transfer tubes 50 mainly extend. In general, as illustrated in FIG. 6, the flow speed in the liquid-header distributor 170 of the lateral-blow housing is high in an area at a middle height but decreases in the height direction toward the lower and upper ends.

The two-phase gas-liquid refrigerant having flowed from the liquid-header inflow/outflow pipe 72 into the liquid-header distributor 170 is sequentially distributed to the plurality of heat-transfer tubes 50 while being affected by gravity. The liquid-phase refrigerant contained in the two-phase gas-liquid refrigerant flowing in the liquid-header distributor 70 has a higher density than the gas-phase refrigerant and is therefore greatly affected by gravity. Accordingly, when the refrigerant flow rate is low, a large amount of liquid refrigerant tends to flow into those heat-transfer tubes 50 that are connected to a lower part of the liquid-header distributor 70. On the other hand, if the refrigerant flow rate is high, a large amount of liquid refrigerant tends to flow into those heat-transfer tubes 50 that are connected to an upper part of the liquid-header distributor 70. That is, the distribution of liquid refrigerant among the plurality of heat-transfer tubes 50 is greatly affected by the change in the refrigerant flow rate.

In particular, at a low refrigerant flow rate, while some portion of the liquid refrigerant is blown upward, some other portion of the liquid refrigerant is pulled downward by gravity. Consequently, a large portion of the liquid refrigerant tends to flow into those heat-transfer tubes 50 that are connected to a lower part of the liquid-header distributor 70. Hence, in the heat exchanger including the liquid-header distributor 170 according to Comparative Embodiment, the amount of liquid refrigerant that flows through the heat-transfer tubes 50 is smaller in an area where the flow speed is higher but is greater in an area where the flow speed is lower. Such a phenomenon deteriorates the performance of the heat exchanger. That is, the liquid-header distributor 170 according to Comparative Embodiment cannot handle a wide range of refrigerant flow rate.

Figure 8:
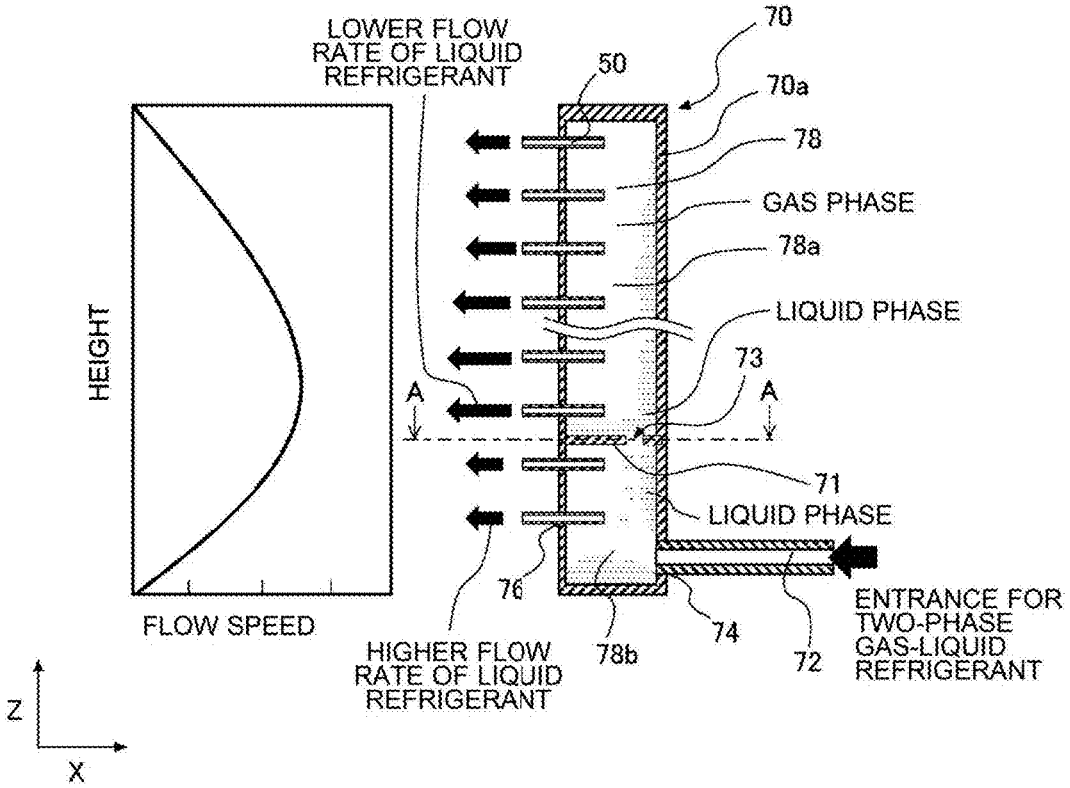
FIG. 8 schematically illustrates the liquid-header distributor according to Embodiment 1, and specifically illustrates how two-phase gas-liquid refrigerant flows in the liquid-header distributor when the outdoor heat exchanger operates as an evaporator.
Figure 9:
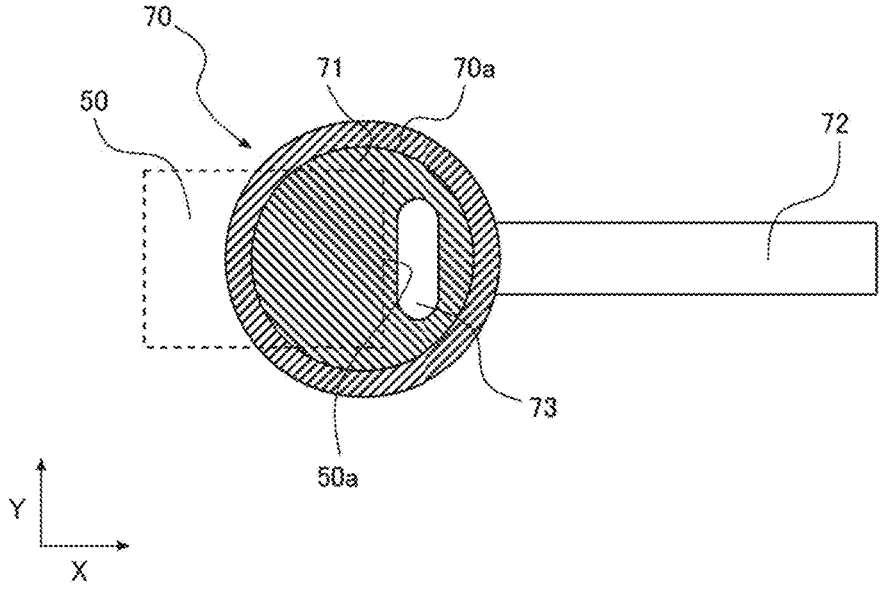
FIG. 9 illustrates a section of the liquid-header distributor illustrated in FIG. 8, taken along line A-A perpendicular to the direction in which the body thereof extends.

FIG. 8 schematically illustrates the liquid-header distributor 70 according to Embodiment 1, and specifically illustrates how two-phase gas-liquid refrigerant flows in the liquid-header distributor 70 when the outdoor heat exchanger 10 operates as an evaporator. FIG. 9 illustrates a section of the liquid-header distributor 70 illustrated in FIG. 8, taken along line A-A perpendicular to the direction in which the body 70*a* thereof extends.

Some portion of the two-phase gas-liquid refrigerant having flowed from the liquid-header inflow/outflow pipe 72 into the liquid-header distributor 70 is sequentially distributed to the plurality of heat-transfer tubes 50 while being affected by gravity. Some portion of the two-phase gas-liquid refrigerant having flowed from the liquid-header inflow/outflow pipe 72 into the liquid-header distributor 70 is sequentially distributed to the plurality of heat-transfer tubes 50 while gathering the speed thereof by passing through the orifice 73 but being affected by gravity.

Since the refrigerant gathers the speed thereof by passing through the orifice 73, the liquid refrigerant reaches an upper part of the liquid-header distributor 70. Thus, in the liquid-header distributor 70 including the orifice plate 71, when the refrigerant flow rate is low, a greater amount of liquid refrigerant flows into those heat-transfer tubes 50 that are connected to an upper part of the liquid-header distributor 70 than in the liquid-header distributor 170 according to Comparative Embodiment including no orifice plate 71.

Furthermore, when the refrigerant flow rate is low, some of the liquid refrigerant in the liquid-header distributor 70 that is pulled downward by gravity is received by the orifice plate 71 spreading around the orifice 73 and is less likely to fall below the orifice plate 71. Moreover, the liquid refrigerant received by the orifice plate 71 spreading around the orifice 73 is dragged by the refrigerant passing through the orifice 73 at an increased speed and thus flows toward an upper part of the liquid-header distributor 70.

Such a configuration of the outdoor heat exchanger 10 facilitates the flow of the liquid refrigerant into those heat-transfer tubes 50 that are connected to a part of the liquid-header distributor 70 that is above the orifice plate 71. Hence, in the outdoor heat exchanger 10, the amount of liquid refrigerant that flows through the heat-transfer tubes 50 is greater in an area where the flow speed is higher and is smaller in an area where the flow speed is lower. Thus, the performance of the heat exchanger is improved. In the outdoor heat exchanger 10, the orifice 73 provided inside the liquid-header distributor 70 facilitates the flow of the liquid refrigerant toward an upper part of the liquid-header distributor 70 and thus suppresses the gathering of the liquid refrigerant in a lower part of the liquid-header distributor 70, whereby the performance of the heat exchanger is improved.

The orifice 73 is provided at such a position that when the orifice 73 and the plurality of heat-transfer tubes 50 are projected on a plane perpendicular to the axial direction of the liquid-header distributor 70, one-half or greater of the opening area of the orifice 73 does not coincide with the plurality of heat-transfer tubes 50. Since the liquid-header distributor 70 has the orifice 73 at such a position, the momentum of the liquid refrigerant having gathered the speed thereof at the orifice 73 is less likely to be reduced by the presence of the plurality of heat-transfer tubes 50.

The orifice 73 is provided at such a position that when the orifice 73 and the plurality of heat-transfer tubes 50 are projected on a plane perpendicular to the axial direction of the liquid-header distributor 70, the orifice 73 does not coincide with the plurality of heat-transfer tubes 50. Since the liquid-header distributor 70 has the orifice 73 at such a position, the momentum of the liquid refrigerant having gathered the speed thereof at the orifice 73 is not reduced by the presence of the plurality of heat-transfer tubes 50.

Letting the number of heat-transfer tubes 50 arranged in parallel with one another in the top-bottom direction be n, the orifice plate 71 is located below an n/2-th one of the heat-transfer tubes 50 counting from the bottom. That is, the liquid refrigerant in the liquid-header distributor 70 gathers the flow speed thereof at a position where the flow speed of the liquid refrigerant is relatively high. Accordingly, a greater effect of speed increase is produced than in a case where the orifice plate 71 is not provided at the position defined above. Such a configuration of the outdoor heat exchanger 10 facilitates the flow of the liquid refrigerant toward an upper part of the liquid-header distributor 70 and thus suppresses the gathering of the liquid refrigerant in a lower part of the liquid-header distributor 70, whereby the performance of the heat exchanger is improved.

The orifice plate 71 may have two or more orifices 73. If the orifice plate 71 has two or more orifices 73, the flow of the liquid refrigerant having passed through the orifices 73 becomes more even in the liquid-header distributor 70 than in the case of one orifice 73. Furthermore, in a case where the distribution of the liquid refrigerant in the liquid-header distributor 70 in a Y-X plane is uneven in an area below the orifice plate 71, the effect of increasing the speed of the liquid refrigerant that is produced when the liquid refrigerant passes through the orifice 73 is less likely to be reduced. Specifically, in a case where the flow rate of the refrigerant is variable or the gas-liquid ratio is variable, since the gathering of the liquid refrigerant in a lower part of the liquid-header distributor 70 is suppressed, the deterioration in the performance of the heat exchanger is suppressed. Even in a case of different physical properties or different other characteristics, since the gathering of the liquid refrigerant in a lower part of the liquid-header distributor 70 is suppressed, the deterioration in the performance of the heat exchanger is suppressed.

Embodiment 2

Figure 10:
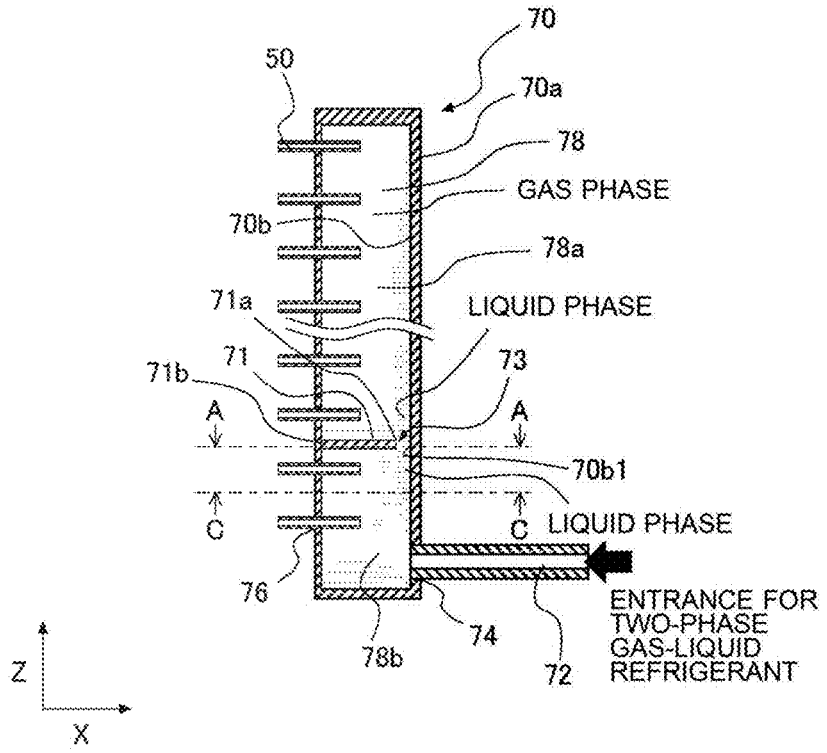
FIG. 10 outlines a liquid-header distributor according to Embodiment 2.
Figure 11:
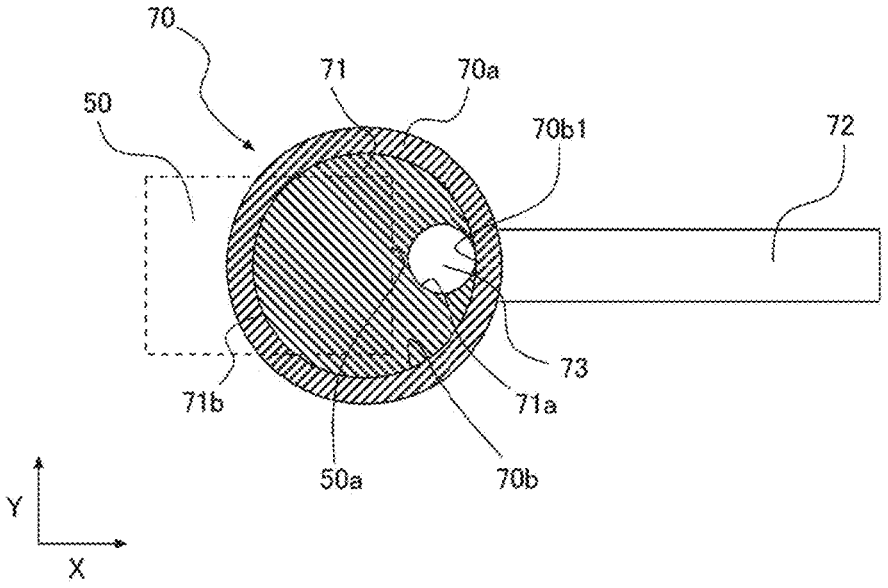
FIG. 11 illustrates a section of the liquid-header distributor illustrated in FIG. 10, taken along line A-A perpendicular to a direction in which a body thereof extends.
Figure 12:
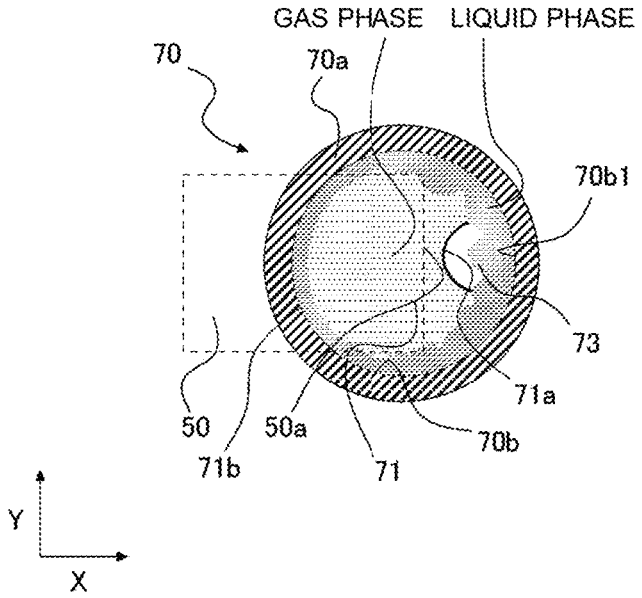
FIG. 12 illustrates a section of the liquid-header distributor illustrated in FIG. 10, taken along line C-C perpendicular to the direction in which the body thereof extends.

FIG. 10 outlines a liquid-header distributor 70 according to Embodiment 2. FIG. 11 illustrates a section of the liquid-header distributor 70 illustrated in FIG. 10, taken along line A-A perpendicular to a direction in which a body 70*a* thereof extends. FIG. 12 illustrates a section of the liquid-header distributor 70 illustrated in FIG. 10, taken along line C-C perpendicular to the direction in which the body 70*a* thereof extends. Elements having the same functions and effects as those such as the liquid-header distributor 70 and other elements according to Embodiment 1 are denoted by corresponding ones of the reference signs, and description of such elements is omitted. The liquid-header distributor 70 according to Embodiment 2 will be described for specifying the position of the orifice 73.

As illustrated in FIG. 10, the orifice plate 71 provided inside the liquid-header distributor 70 has an orifice 73, which is in contact with an inner wall, 70*b*, of the body 70*a* forming the liquid-header distributor 70. Specifically, in the internal space 78 of the body 70*a*, the orifice 73 that allows the top space 78*a* and the bottom space 78*b* to communicate with each other is defined by an edge, 71*a*, of the orifice plate 71 and the inner wall 70*b* of the body 70*a*. In other words, a part of the inner wall of the orifice 73 is formed by an inner wall, 70*b*1, of the liquid-header distributor 70.

In a plane perpendicular to the axial direction of the liquid-header distributor 70, the edge 71*a* of the orifice plate 71 is recessed toward the center of the orifice plate 71 relative to an edge 71*b*, which adjoins the edge 71*a* in the peripheral direction. The edge 71*a* of the orifice plate 71 is spaced apart from the inner wall 70*b* of the body 70*a*, whereas the edge 71*b* of the orifice plate 71 is in contact with the inner wall 70*b* of the body 70*a*.

A part of the orifice 73 is defined by the inner wall 70*b*1, which forms a part of the surface of the liquid-header distributor 70 that is opposite a part where the plurality of heat-transfer tubes 50 are connected. Desirably, the inner wall 70*b*1 that defines the orifice 73 may be a wall portion located above the inlet 74. However, the inner wall 70*b* that defines the orifice 73 is not limited to a wall portion located above the inlet 74.

When the outdoor heat exchanger 10 operates as an evaporator, the refrigerant having passed through the liquid-header inflow/outflow pipe 72 flows into the liquid-header distributor 70 and is sequentially distributed to the plurality of heat-transfer tubes 50 while flowing upward in the liquid-header distributor 70. In this process, in a section of the liquid-header distributor 70 that is perpendicular to the longitudinal direction and located below the orifice plate 71, that is, in the section illustrated in FIG. 12 that is taken along line C-C, the liquid refrigerant flows upward along a part of the inner wall 70*b* of the liquid-header distributor 70 that is located above the liquid-header inflow/outflow pipe 72. On the other hand, the gas refrigerant flows through an area of the liquid-header distributor 70 that is on the inner side relative to the flow of the liquid refrigerant.

<Functional Effects of Outdoor Heat Exchanger 10>

In the liquid-header distributor 70 according to Embodiment 2, the orifice 73 is in contact with the inner wall 70*b* of the body 70*a* forming the liquid-header distributor 70. Furthermore, a part of the orifice 73 is defined by the inner wall 70*b*1, which forms a part of the surface of the liquid-header distributor 70 that is opposite a part where the plurality of heat-transfer tubes 50 are connected. In short, the orifice 73 is defined by the edge 71*a* of the orifice plate 71 and the inner wall 70*b*1 of the liquid-header distributor 70. A part of the inner wall of the orifice 73 is formed by the inner wall 70*b*1 of the liquid-header distributor 70.

In the liquid-header distributor 70 configured as above, an area in the body 70*a* where the liquid refrigerant flowing upward in the liquid-header distributor 70 is present overlaps the projection of the orifice 73 on the section taken along line B-B. Therefore, the upward flow of the liquid refrigerant in the liquid-header distributor 70 is not hindered by the orifice plate 71 having the orifice 73. Therefore, an increased amount of liquid refrigerant flows upward. In the outdoor heat exchanger 10, the liquid refrigerant more easily passes through the orifice 73 than in a case where the orifice 73 is not provided at the position defined above. Accordingly, the liquid refrigerant more easily flows into those heat-transfer tubes 50 that are connected to an upper part of the liquid-header distributor 70, whereby the performance of the heat exchanger is further improved.

Figure 13:
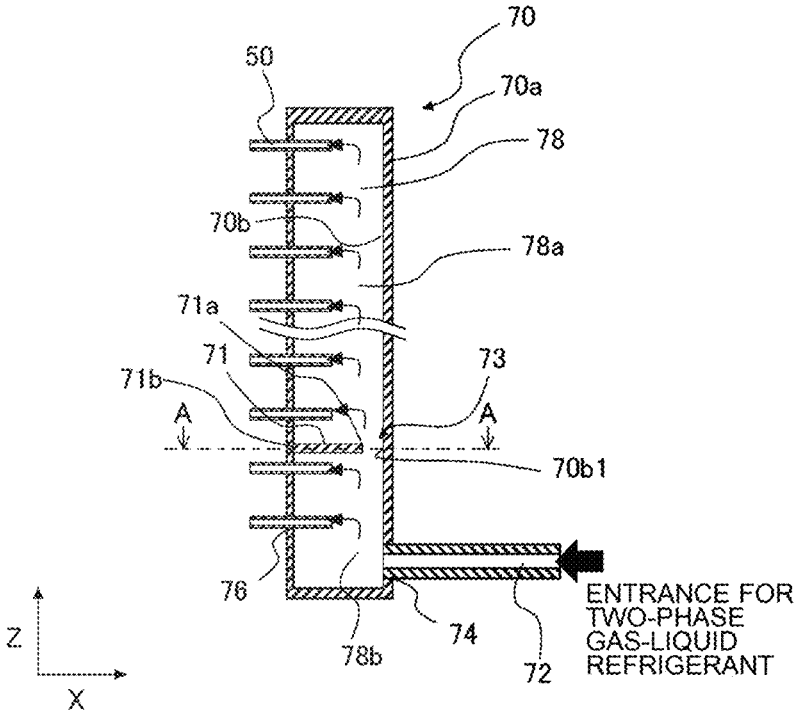
FIG. 13 outlines a first edification of the liquid-header distributor according to Embodiment 2.
Figure 14:
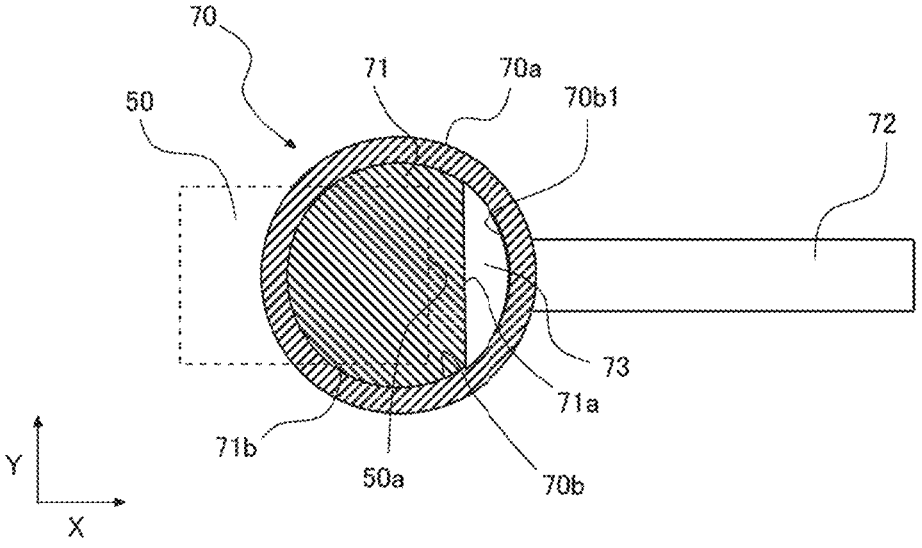
FIG. 14 illustrates a section of the liquid-header distributor illustrated in FIG. 13, taken along line A-A perpendicular to the direction in which the body thereof extends.

FIG. 13 outlines a first modification of the liquid-header distributor 70 according to Embodiment 2. FIG. 14 illustrates a section of the liquid-header distributor 70 illustrated in FIG. 13, taken along line A-A perpendicular to the direction in which the body 70*a* thereof extends. The first modification of the liquid-header distributor 70 according to Embodiment 2 will be described for specifying the shape of the orifice 73 of the liquid-header distributor 70 according to Embodiment 2.

The orifice 73 of the liquid-header distributor 70 described in Embodiment 1 is shaped as an oblong hole or any other opening. Likewise, the orifice 73 of the liquid-header distributor 70 described in Embodiment 2 may desirably be an oblong hole, with a part of the edge of the orifice 73 being formed by a part of the inner wall 70*b* of the liquid-header distributor 70 that faces toward the tips of the heat-transfer tubes 50 and is continuous with the orifice 73. The orifice 73 defined by the orifice plate 71 and the inner wall 70*b*1 of the body 70*a* may desirably be an oblong hole whose opening size is greater in a horizontal direction, specifically, the Y-axis direction represented in FIG. 14, orthogonal to the direction in which the heat-transfer tubes 50 extend. For example, as illustrated in FIGS. 13 and 14, in a plane perpendicular to the axial direction of the liquid-header distributor 70, the orifice 73 may have a semicircular shape defined by an arc-shaped inner wall 70*b*1 and a linear edge 71*a*.

Figure 15:
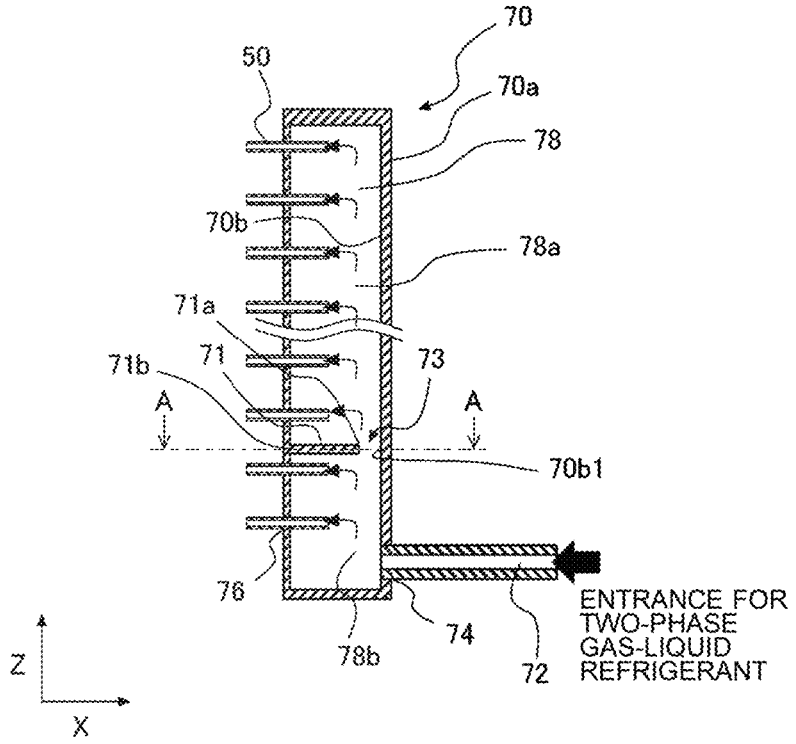
FIG. 15 outlines a second modification of the liquid-header distributor according to Embodiment 2.
Figure 16:
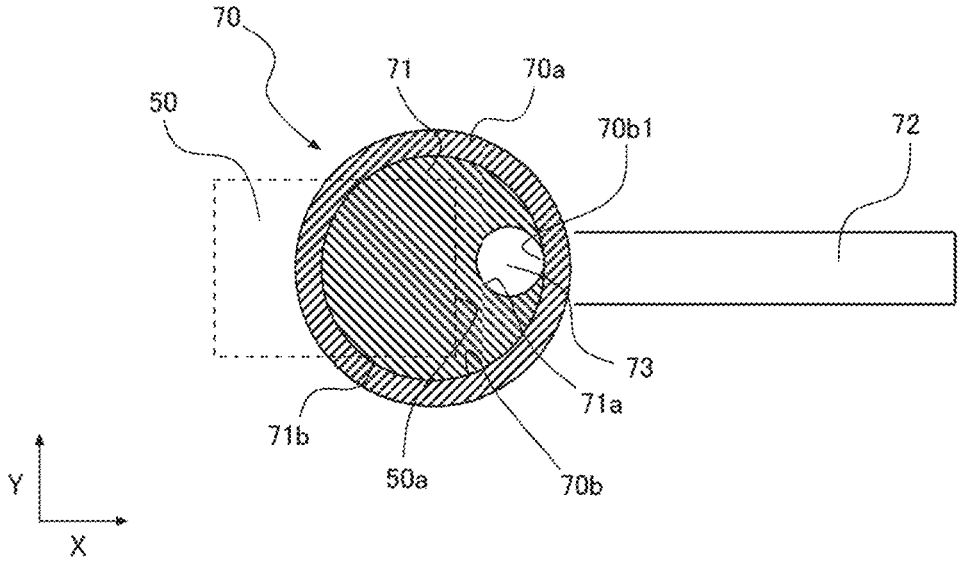
FIG. 16 illustrates a section of the liquid-header distributor illustrated in FIG. 15, taken along line A-A perpendicular to the direction in which the body thereof extends.

FIG. 15 outlines a second modification of the liquid-header distributor 70 according to Embodiment 2. FIG. 16 illustrates a section of the liquid-header distributor 70 illustrated in FIG. 15, taken along line A-A perpendicular to the direction in which the body 70*a* thereof extends. The orifice 73 defined by the orifice plate 71 and the inner wall 70*b*1 of the body 70*a* is not limited to an oblong hole. The orifice 73 defined by the orifice plate 71 and the inner wall 70*b*1 of the body 70*a* may be a circular hole.

Even if the orifice 73 is a circular hole, since a part of the orifice 73 is defined by the inner wall 70*b*1 of the body 70*a*, the liquid refrigerant flows upward in the liquid-header distributor 70 along the inner wall 70*b*1 that extends continuously in the top-bottom direction. Therefore, the outdoor heat exchanger 10 including the liquid-header distributor 70 configured as above produces an effect of causing the liquid refrigerant to flow upward.

While FIGS. 10 to 16 illustrate a case where only one orifice 73 is provided by utilizing the inner wall 70*b* of the body 70*a*, the number of orifices 73 is not limited to one. Two or more orifices 73 may be provided by utilizing the inner wall 70*b* of the body 70*a*.

Embodiment 3

Figure 17:
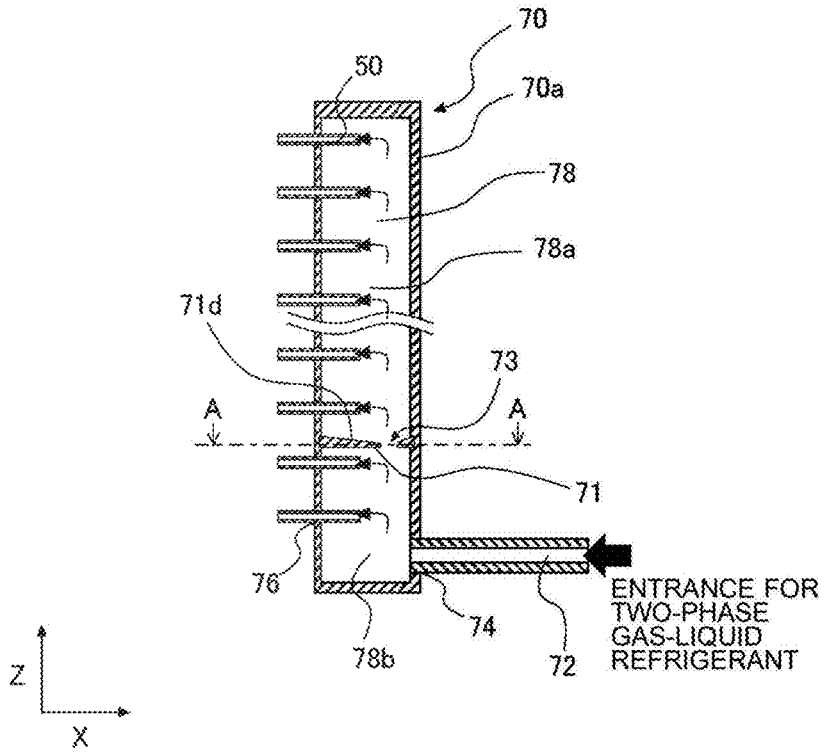
FIG. 17 outlines a first example of a liquid-header distributor according to Embodiment 3.
Figure 18:
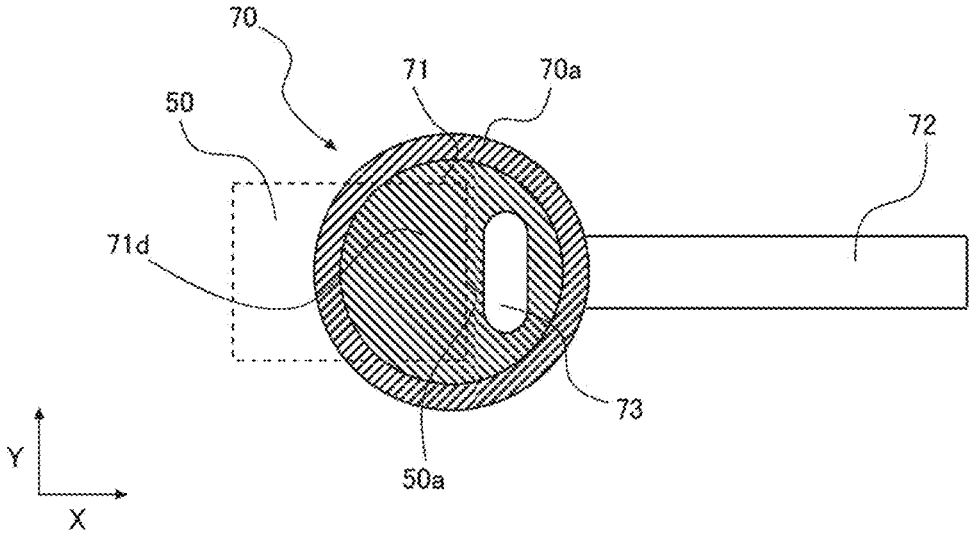
FIG. 18 illustrates a section of the liquid-header distributor illustrated in FIG. 17, taken along line A-A perpendicular to a direction in which a body thereof extends.

FIG. 17 outlines a first example of a liquid-header distributor 70 according to Embodiment 3. FIG. 18 illustrates a section of the liquid-header distributor 70 illustrated in FIG. 17, taken along line A-A perpendicular to a direction in which a body 70*a* thereof extends. Elements having the same functions and effects as those such as the liquid-header distributor 70 and other elements according to Embodiment 1 or 2 are denoted by corresponding ones of the reference signs, and description of such elements is omitted. The liquid-header distributor 70 according to Embodiment 3 will be described for specifying the shape of the orifice plate 71.

The orifice plate 71 has a top face 71*d*, which is inclined downward toward the orifice 73 when the orifice plate 71 is seen in a section taken in the axial direction of the liquid-header distributor 70 as illustrated in FIG. 17. Specifically, the orifice plate 71 is inclined in such a direction that the center of gravity of the orifice 73 in the section is at a lower position of the orifice plate 71. The top face 71*d* of the orifice plate 71 is recessed in an oblique circular conical shape at the deepest part of which the orifice 73 is provided. In other words, the top face 71*d* of the orifice plate 71 forms a conical shape at the deepest part of which the orifice 73 is provided. The top face 71*d* of the orifice plate 71 forms a surface of the orifice plate 71 that defines the top space 78*a*.

Figure 19:
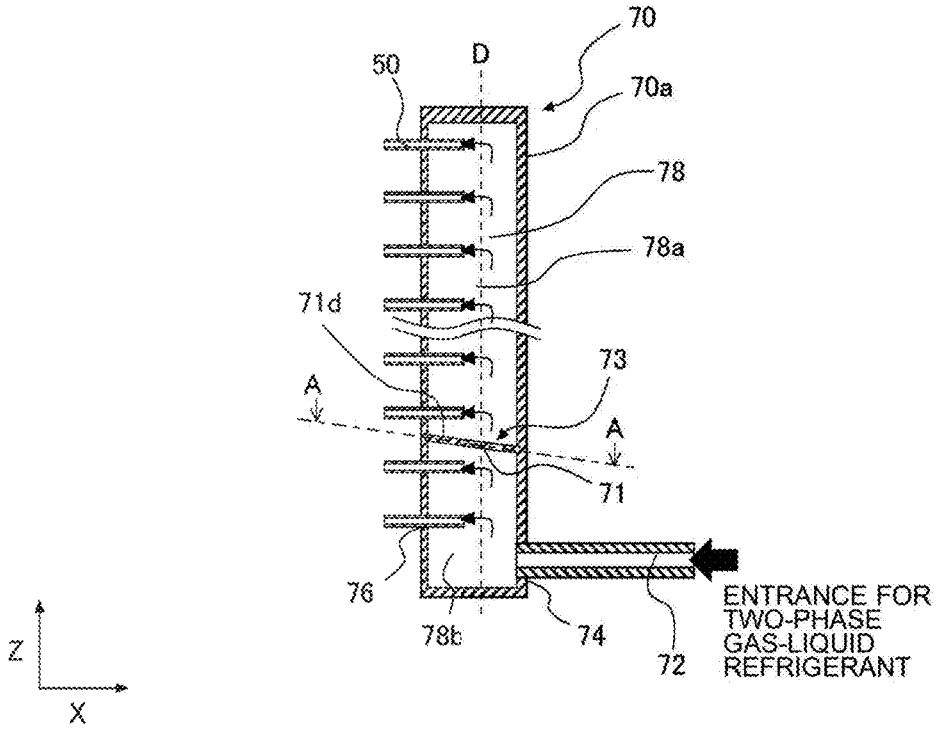
FIG. 19 outlines a second example of the liquid-header distributor according to Embodiment 3.
Figure 20:
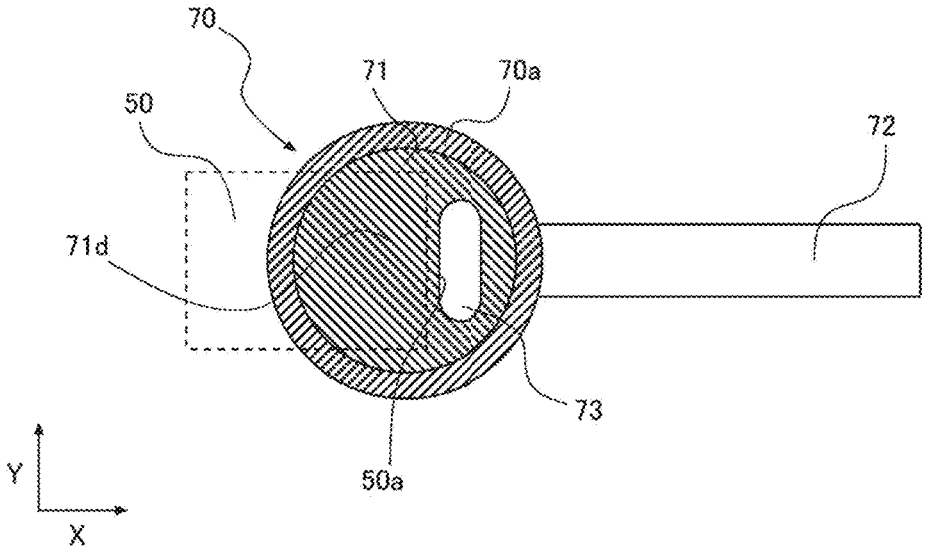
FIG. 20 illustrates a section of the liquid-header distributor illustrated in FIG. 19, taken along line A-A.

FIG. 19 outlines a second example of the liquid-header distributor 70 according to Embodiment 3. FIG. 20 illustrates a section of the liquid-header distributor 70 illustrated in FIG. 19, taken along line A-A. As illustrated in FIG. 19, the orifice plate 71 having the orifice 73 is inclined downward toward a part of the surface of the liquid-header distributor 70 that is opposite a part where the plurality of heat-transfer tubes 50 are connected. In other words, the orifice plate 71 is inclined downward toward a part of the inner wall surface of the liquid-header distributor 70 that is opposite the position of connection between the plurality of heat-transfer tubes 50 and the liquid-header distributor 70. In this example, the orifice 73 is provided in a lower part of the orifice plate 71 that is inclined in the top-bottom direction.

The orifice plate 71 is inclined relative to a pipe axis D, defined for the liquid-header distributor 70. In the liquid-header distributor 70 configured as illustrated in FIGS. 19 and 20, the orifice plate 71 extends from a part of the wall surface where the heat-transfer tubes 50 are connected and is inclined downward toward another part of the wall surface where the liquid-header inflow/outflow pipe 72 is connected.

Figure 21:
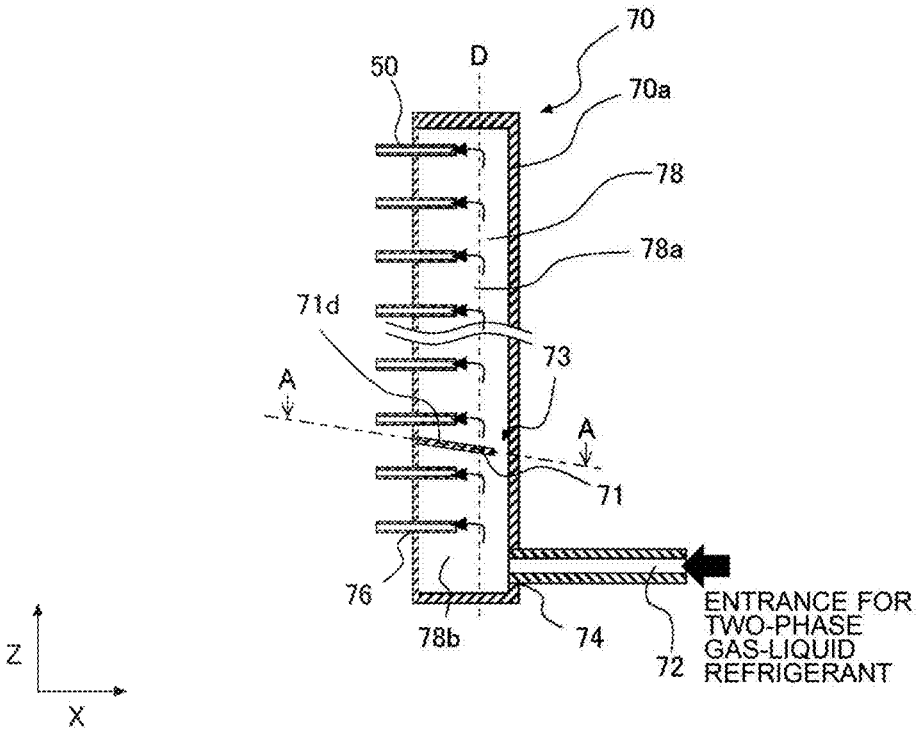
FIG. 21 outlines a third example of the liquid-header distributor according to Embodiment 3.
Figure 22:
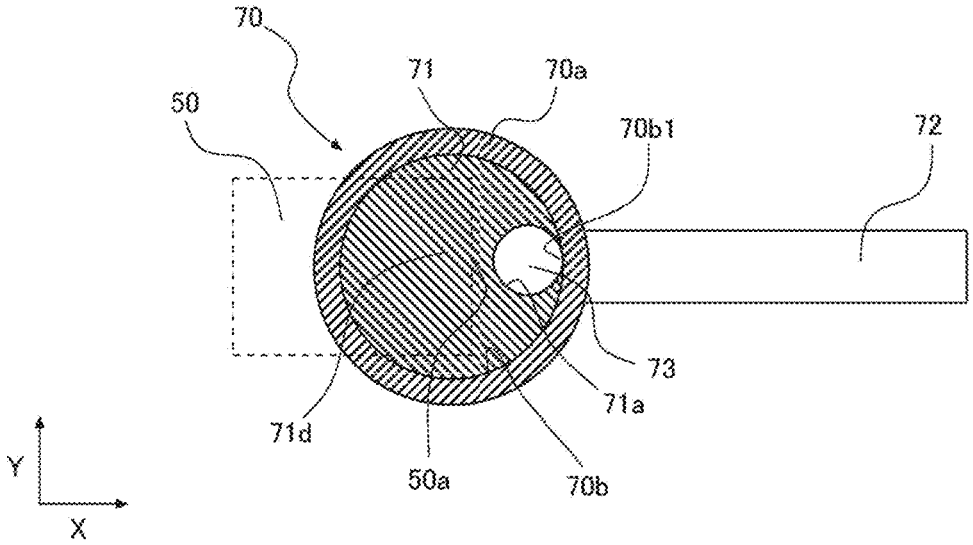
FIG. 22 illustrates a section of the liquid-header distributor illustrated in FIG. 21, taken along line A-A.

FIG. 21 outlines a third example of the liquid-header distributor 70 according to Embodiment 3. FIG. 22 illustrates a section of the liquid-header distributor 70 illustrated in FIG. 21, taken along line A-A. The orifice 73 is a circular hole and is defined by the edge 71*a* of the orifice plate 71 and the inner wall 70*b*1 of the body 70*a*.

Figure 23:
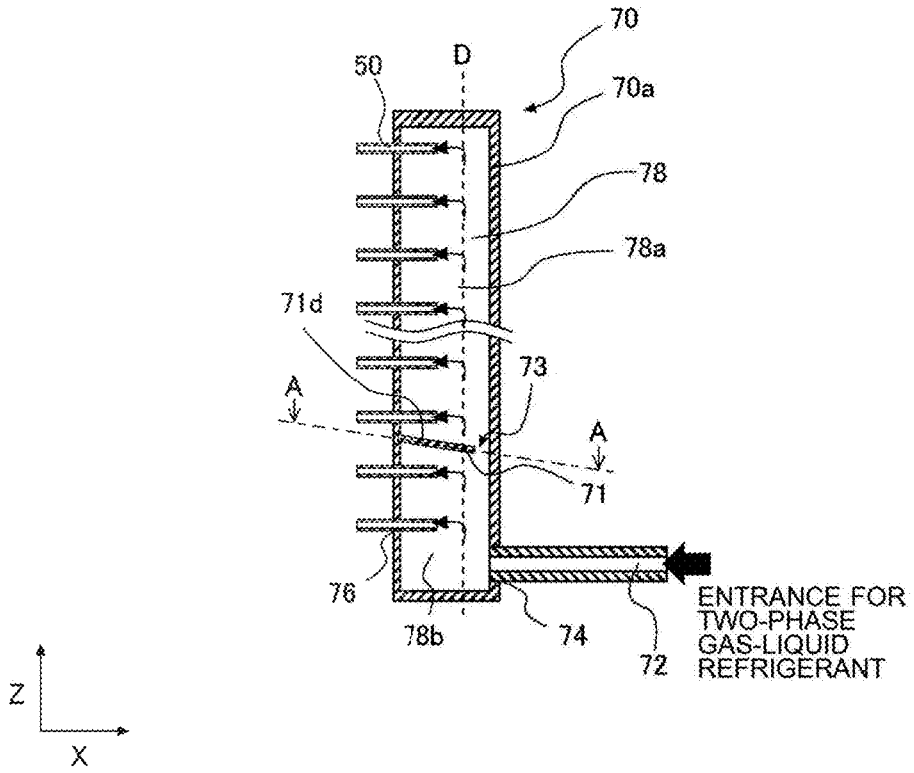
FIG. 23 outlines another third example of the liquid-header distributor according to Embodiment 3.
Figure 24:
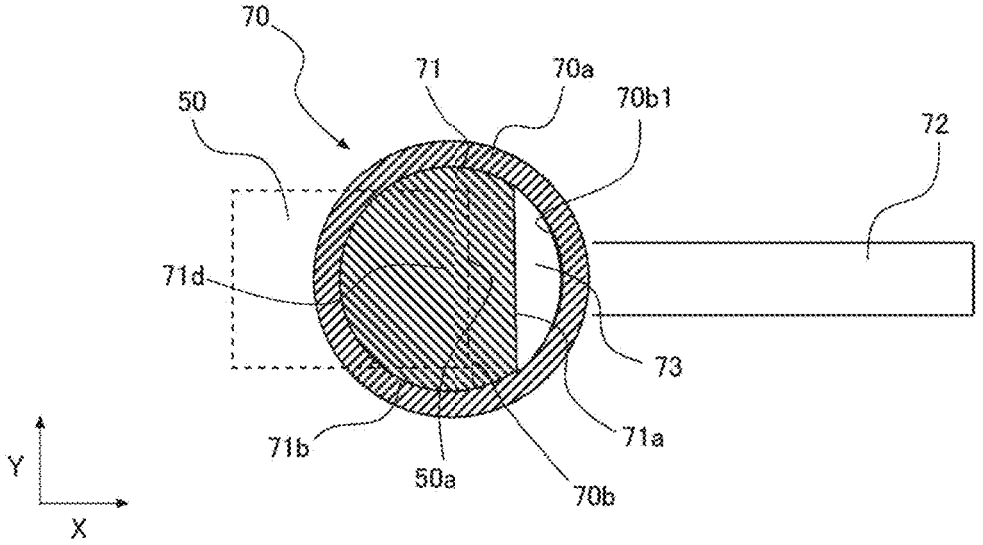
FIG. 24 illustrates a section of the liquid-header distributor illustrated in FIG. 23, taken along line A-A.

FIG. 23 outlines another third example of the liquid-header distributor 70 according to Embodiment 3. FIG. 24 illustrates a section of the liquid-header distributor 70 illustrated in FIG. 23, taken along line A-A. The orifice 73 is an oblong hole and is defined by the edge 71*a* of the orifice plate 71 and the inner wall 70*b*1 of the body 70*a*.

In each of the third examples of the liquid-header distributor 70 illustrated in FIGS. 21 to 24, the orifice 73 is in contact with the inner wall 70*b* of the body 70*a* forming the liquid-header distributor 70. Furthermore, a part of the orifice 73 is defined by the inner wall 70*b*1, which forms a part of the surface of the liquid-header distributor 70 that is opposite a part where the plurality of heat-transfer tubes 50 are connected. Furthermore, the orifice plate 71 that defines a part of the orifice 73 is inclined downward toward the orifice 73.

<Functional Effects of Outdoor Heat Exchanger 10>

The orifice plate 71 is inclined in such a direction that the center of gravity of the orifice 73 in the section is at a lower position of the orifice plate 71. Furthermore, the top face 71*d* of the orifice plate 71 is recessed in an oblique circular conical shape at the deepest part of which the orifice 73 is provided. In short, the liquid-header distributor 70 includes the orifice plate 71 having a surface inclined toward the orifice 73. Therefore, the liquid refrigerant having reached an area above the orifice plate 71 flows along the top face 71*d* of the orifice plate 71 having the orifice 73 and gathers around the orifice 73.

Furthermore, the orifice plate 71 is inclined downward toward a part of the inner wall surface of the liquid-header distributor 70 that is opposite the position of connection between the plurality of heat-transfer tubes 50 and the liquid-header distributor 70. Therefore, the liquid refrigerant having reached an area above the orifice plate 71 flows along the top face 71*d* of the orifice plate 71 having the orifice 73 and gathers around the orifice 73.

The liquid refrigerant gathered around the orifice 73 is dragged by the flow of the refrigerant that occurs from the lower side toward the upper side of the orifice 73, and therefore easily flows toward an upper part of the liquid-header distributor 70. Consequently, the liquid refrigerant more easily flows into the plurality of heat-transfer tubes 50 connected to the liquid-header distributor 70, and the gathering of the liquid refrigerant in a lower part of the liquid-header distributor 70 is suppressed. Accordingly, the performance of the outdoor heat exchanger 10 as the heat exchanger is improved.

Embodiment 4

Figure 25:
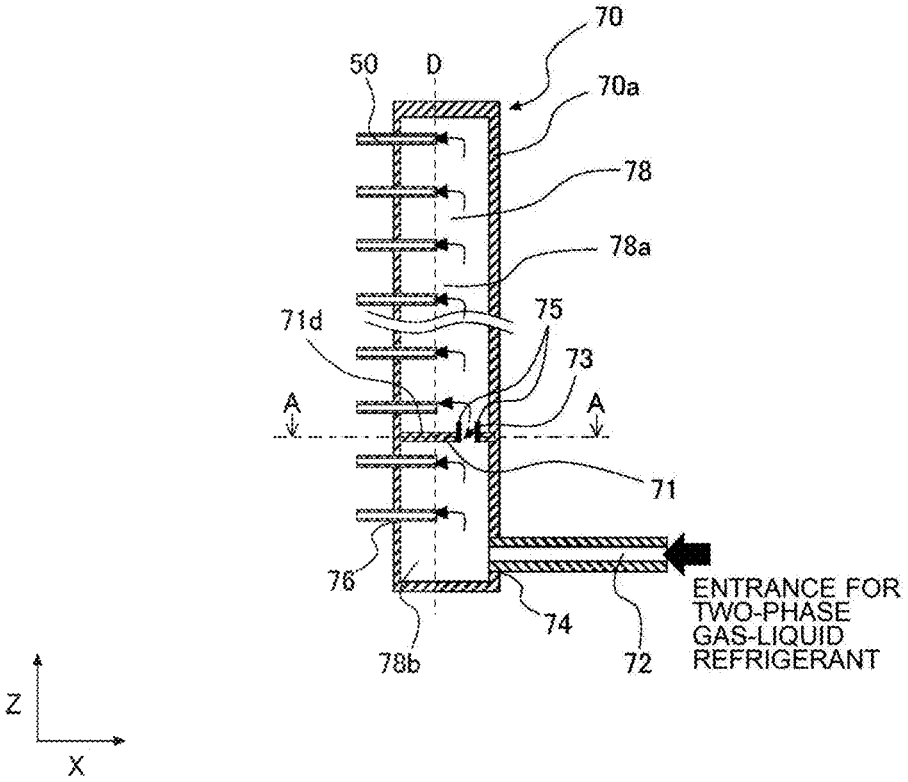
FIG. 25 outlines a first example of a liquid-header distributor according to Embodiment 4.
Figure 26:
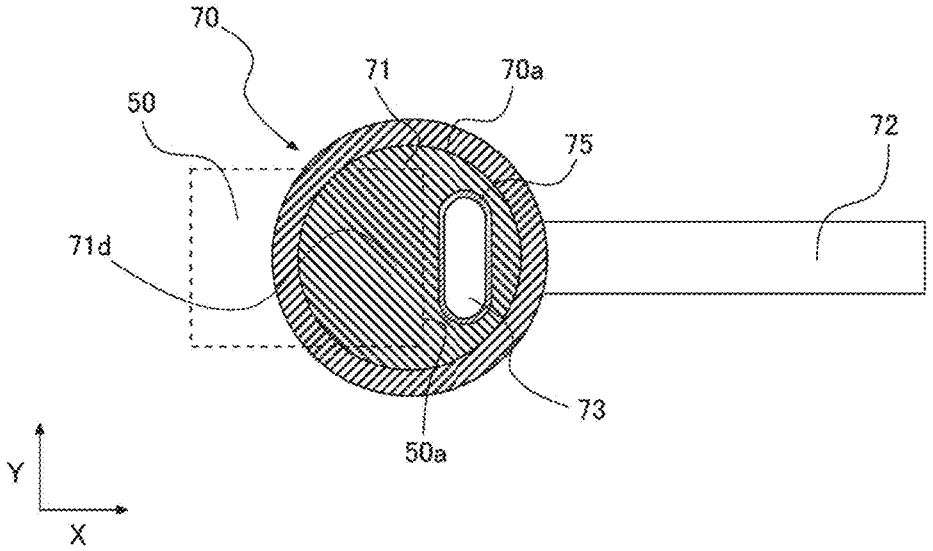
FIG. 26 illustrates a section of the liquid-header distributor illustrated in FIG. 25, taken along line A-A perpendicular to a direction in which a body thereof extends.

FIG. 25 outlines a first example of a liquid-header distributor 70 according to Embodiment 4. FIG. 26 illustrates a section of the liquid-header distributor 70 illustrated in FIG. 25, taken along line A-A perpendicular to a direction in which a body 70*a* thereof extends. Elements having the same functions and effects as those such as the liquid-header distributor 70 and other elements according to any of Embodiments 1 to 3 are denoted by corresponding ones of the reference signs, and description of such elements is omitted. The liquid-header distributor 70 according to Embodiment 4 will be described for further specifying the shape of the orifice plate 71 at the orifice 73.

As illustrated in FIGS. 25 and 26, the orifice plate 71 of the liquid-header distributor 70 according to Embodiment 4 includes a projecting wall 75 at the inner edge of the orifice 73. The projecting wall 75 is formed along the edge of the orifice 73. Therefore, when seen in the direction of the pipe axis D of the liquid-header distributor 70, the projecting wall 75 has the same shape as the orifice 73. The projecting wall 75 projects upward from the top face 71*d* of the orifice plate 71. In other words, the projecting wall 75 projects from the top face 71*d* of the orifice plate 71 into the top space 78*a*.

Figure 27:
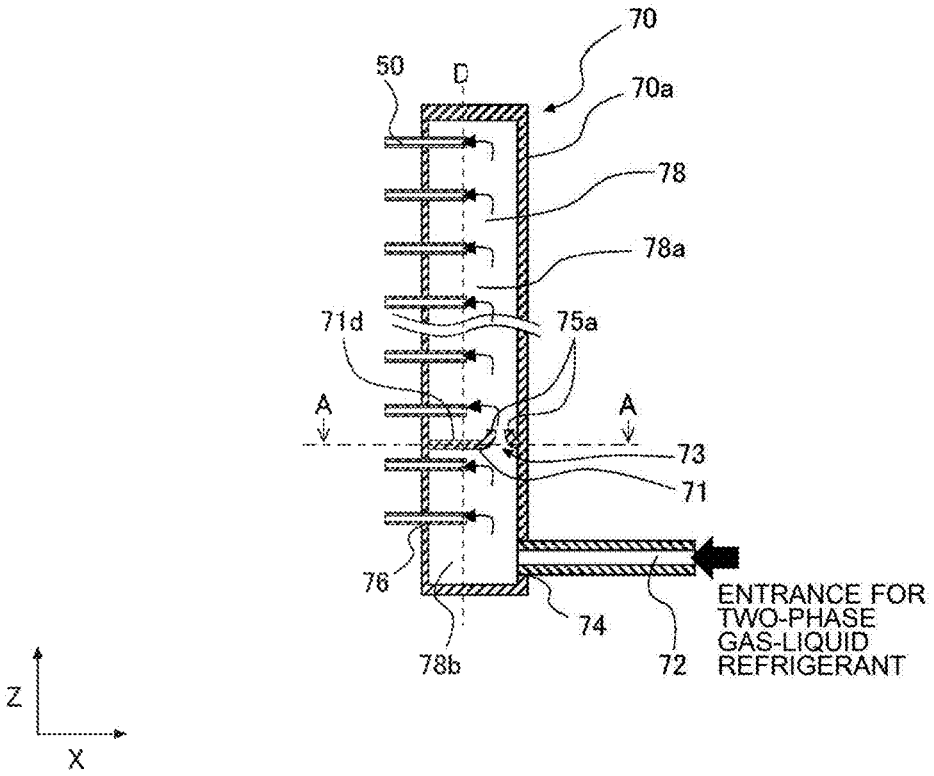
FIG. 27 outlines a second example of the liquid-header distributor according to Embodiment 4.
Figure 28:
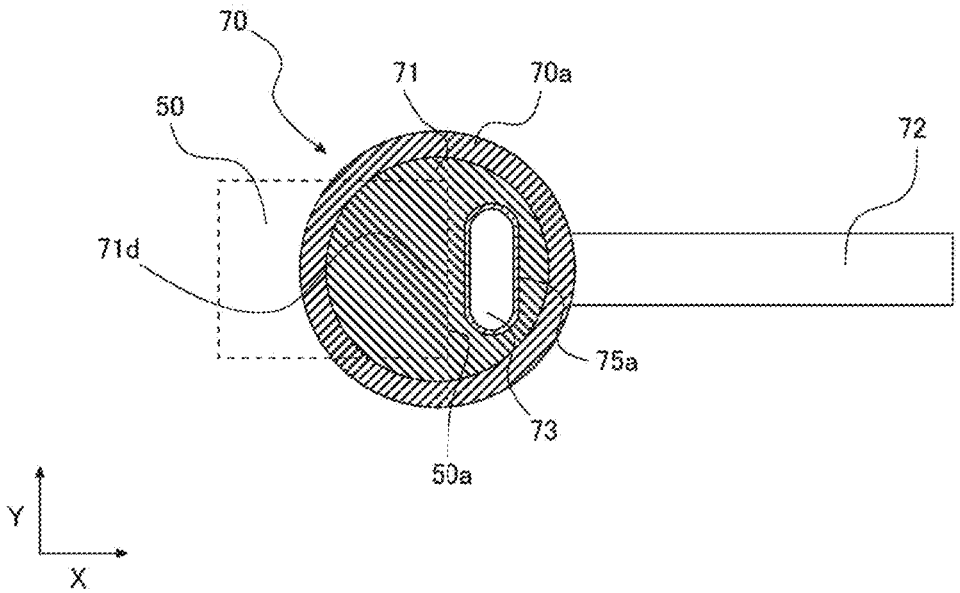
FIG. 28 illustrates a section of the liquid-header distributor illustrated in FIG. 27, taken along line A-A perpendicular to the direction in which the body thereof extends.

FIG. 27 outlines a second example of the liquid-header distributor 70 according to Embodiment 4. FIG. 28 illustrates a section of the liquid-header distributor 70 illustrated in FIG. 27, taken along line A-A perpendicular to the direction in which the body 70*a* thereof extends. The liquid-header distributor 70 according to the second example includes a projecting wall 75*a*. The projecting wall 75*a* basically has the same structure as the above projecting wall 75 according to the first example.

The projecting wall 75*a* is, for example, a burr formed by burring. The projecting wall 75*a* serves as a flange rising at the peripheral edge of the orifice 73. Thus, the projecting wall 75*a* forms a wall projecting upward from the top face 71*d* of the orifice plate 71.

<Functional Effects of Outdoor Heat Exchanger 10>

As illustrated in FIGS. 25 to 28, the orifice plate 71 of each of the liquid-header distributors 70 includes the projecting wall 75 or the projecting wall 75*a* provided at the peripheral edge of the orifice 73 and projecting upward from the top face 71*d*. Since the orifice plate 71 includes the projecting wall 75 or the projecting wall 75*a* at the periphery of the orifice 73, the liquid refrigerant is less likely to flow downward from the orifice 73.

Therefore, the liquid refrigerant having reached an area above the orifice plate 71 is received by a greater amount by the orifice plate 71 having the orifice 73 than in a case where the orifice plate 71 includes neither the projecting wall 75 nor the projecting wall 75*a*. The liquid refrigerant received by the orifice plate 71 having the orifice 73 is dragged by the refrigerant passing through the orifice 73 at an increased speed and therefore easily flows toward an upper part of the liquid-header distributor 70. Furthermore, according to Embodiment 4, the presence of the projecting wall 75 or the projecting wall 75*a* reduces the pressure loss that occurs when the liquid refrigerant passes through the orifice 73. Therefore, the flow rate of the refrigerant that passes through the orifice 73 is increased. Hence, in the outdoor heat exchanger 10, an increased amount of liquid refrigerant is caused to flow into those heat-transfer tubes 50 that are connected to an upper part of the liquid-header distributor 70. Thus, the performance of the heat exchanger is improved.

Embodiment 5

Figure 29:
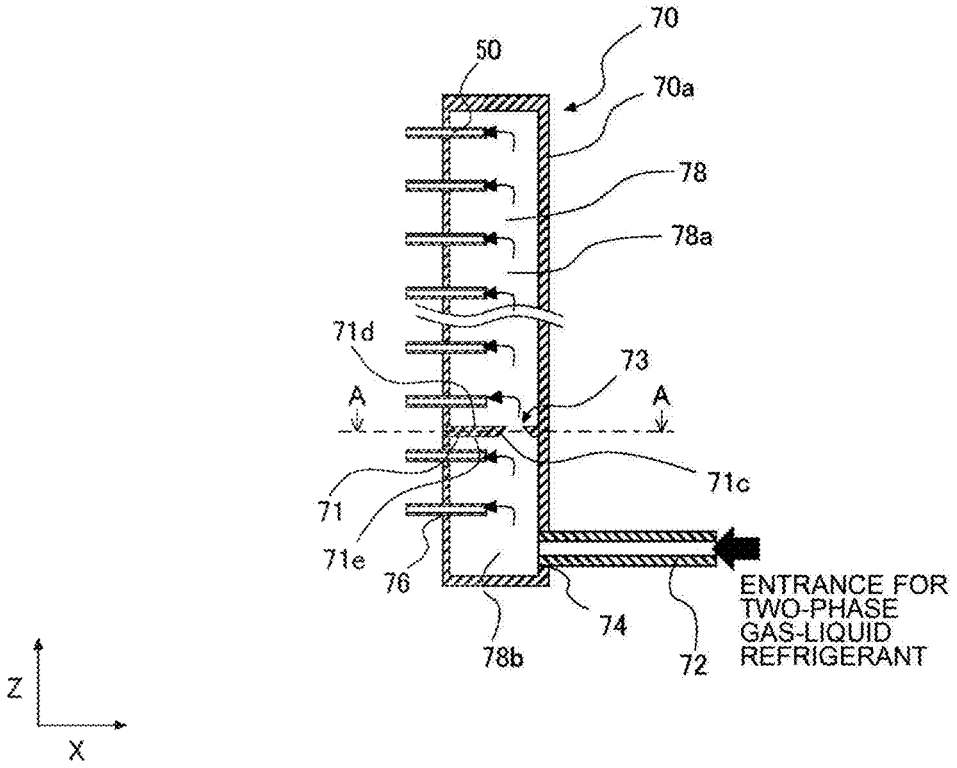
FIG. 29 outlines a first example of a liquid-header distributor according to Embodiment 5.
Figure 30:
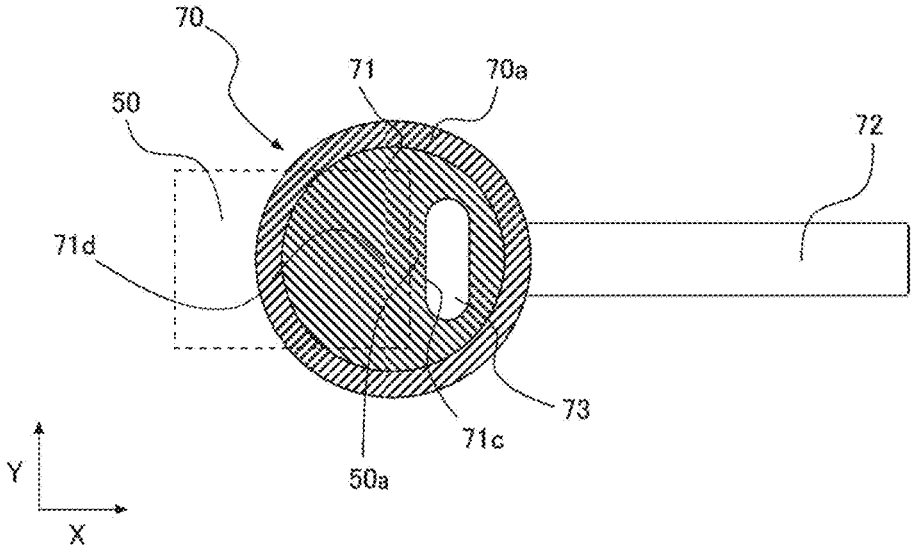
FIG. 30 illustrates a section of the liquid-header distributor illustrated in FIG. 29, taken along line A-A.
Figure 31:
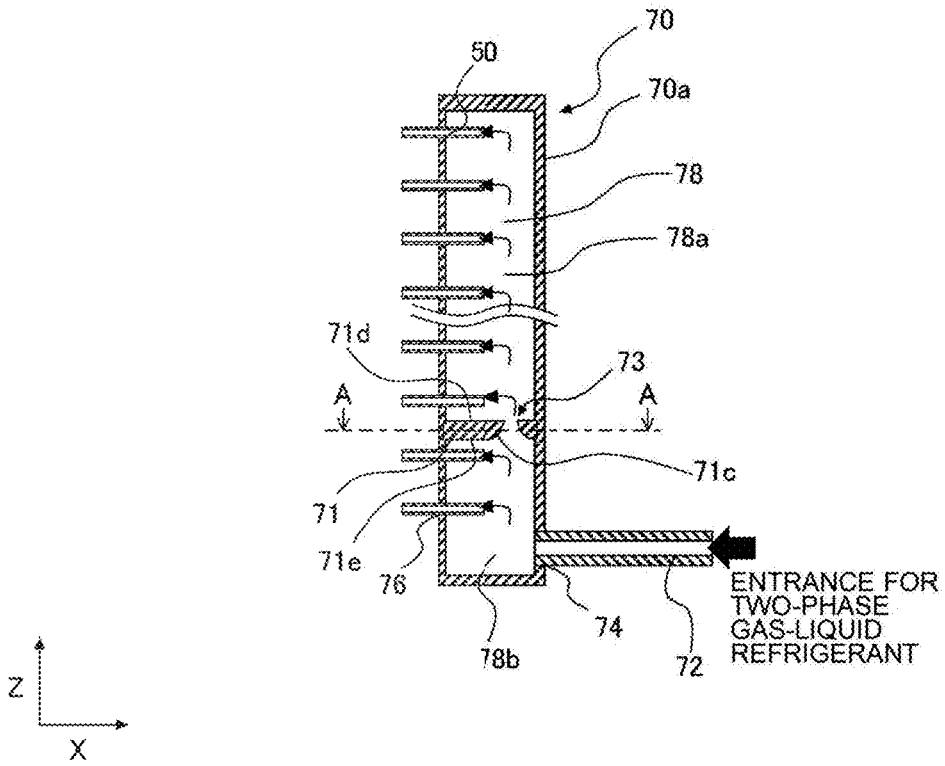
FIG. 31 outlines another first example of the liquid-header distributor according to Embodiment 5.
Figure 32:
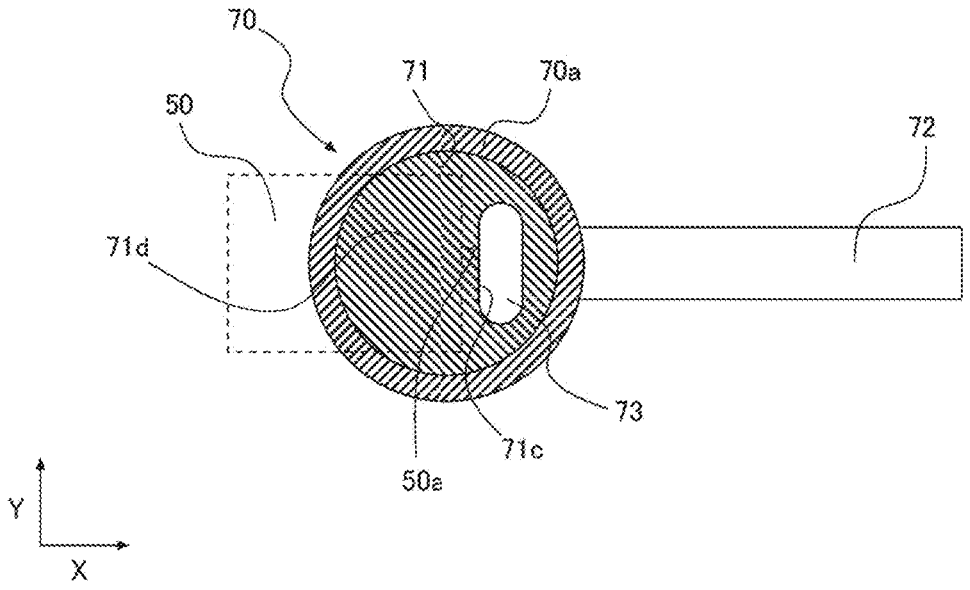
FIG. 32 illustrates a section of the liquid-header distributor illustrated in FIG. 31, taken along line A-A.

FIG. 29 outlines a first example of a liquid-header distributor 70 according to Embodiment 5. FIG. 30 illustrates a section of the liquid-header distributor 70 illustrated in FIG. 29, taken along line A-A. FIG. 31 outlines another first example of the liquid-header distributor 70 according to Embodiment 5. FIG. 32 illustrates a section of the liquid-header distributor 70 illustrated in FIG. 31, taken along line A-A. Elements having the same functions and effects as those such as the liquid-header distributor 70 and other elements according to any of Embodiments 1 to 4 are denoted by corresponding ones of the reference signs, and description of such elements is omitted. The liquid-header distributor 70 according to Embodiment 5 will be described for further specifying the shape of the orifice plate 71 at the orifice 73.

The orifice plate 71 according to the latter first example illustrated in FIGS. 31 and 32 is thicker than the orifice plate 71 according to the first example illustrated in FIGS. 29 and 30. Each of the orifice plates 71 illustrated in FIGS. 29 to 32 is shaped such that the thickness of an edge 71*c*, which defines the orifice 73, is reduced toward the center of the orifice 73 of the orifice plate 71.

The edge 71*c* defining the orifice 73 is shaped to be thinner at the top face 71*d* of the orifice plate 71 than at a bottom face 71*e*. That is, the orifice plate 71 is shaped such that the edge 710 defining the orifice 73 becomes thinner toward the upper side. The opening size of the orifice 73 decreases from the bottom face 71*e* toward the top face 71*d*. The edge 710 defining the orifice 73 may form a wall surface, defining the hollow part, that extends flat between the bottom face 71*e* and the top face 71*d* or curved in an arc shape between the bottom face 71*e* and the top face 71*d*.

Figure 33:
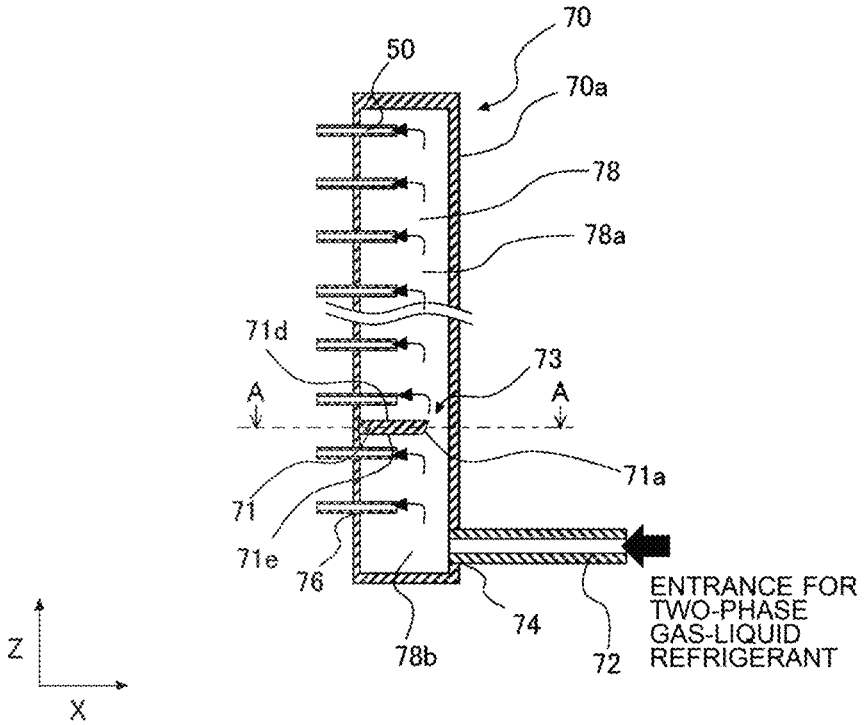
FIG. 33 outlines a second example of the liquid-header distributor according to Embodiment 5.
Figure 34:
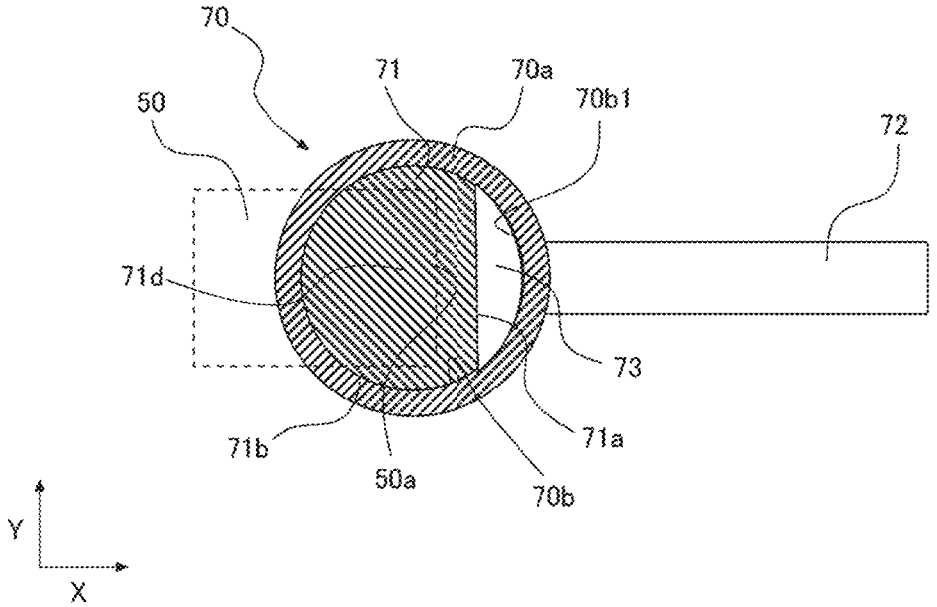
FIG. 34 illustrates a section of the liquid-header distributor illustrated in FIG. 33, taken along line A-A.
Figure 35:
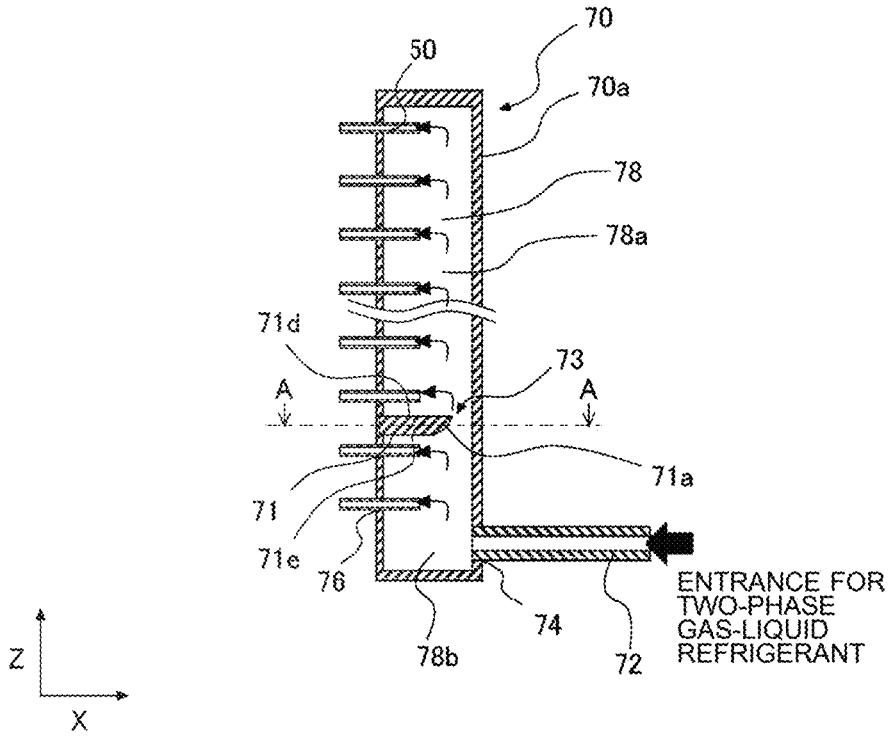
FIG. 35 outlines another second example of the liquid-header distributor according to Embodiment 5.
Figure 36:
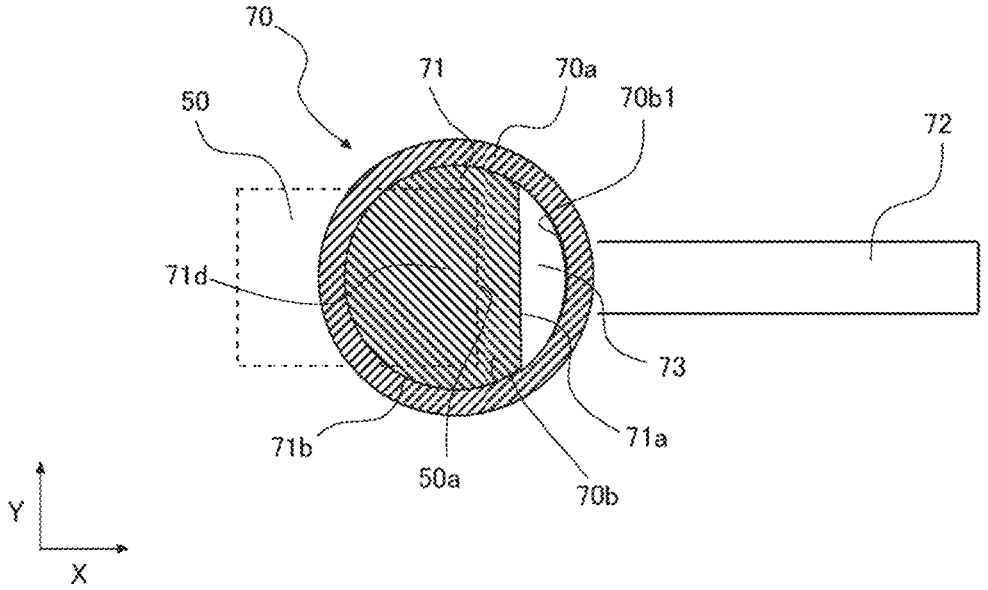
FIG. 36 illustrates a section of the liquid-header distributor illustrated in FIG. 35, taken along line A-A.

FIG. 33 outlines a second example of the liquid-header distributor 70 according to Embodiment 5. FIG. 34 illustrates a section of the liquid-header distributor 70 illustrated in FIG. 33, taken along line A-A. FIG. 35 outlines another second example of the liquid-header distributor 70 according to Embodiment 5. FIG. 36 illustrates a section of the liquid-header distributor 70 illustrated in FIG. 35, taken along line A-A.

The orifice plate 71 according to the latter second example illustrated in FIGS. 35 and 36 is thicker than the orifice plate 71 according to the second example illustrated in FIGS. 33 and 34. Each of the orifice plates 71 illustrated in FIGS. 33 to 36 is shaped such that the thickness of the edge 71*a* defining the orifice 73 is reduced toward the center of the orifice 73 of the orifice plate 71.

The orifice 73 is narrowed toward the upper side in the direction of the pipe axis of the liquid-header distributor 70. The edge 71*a* defining the orifice 73 becomes thinner toward the center of the orifice 73 and on a side near the top face 71*d* of the orifice plate 71 than on a side near the bottom face 71*e* of the orifice plate 71. That is, the orifice plate 71 is shaped such that the opening size of the orifice 73 decreases from the side near the bottom face 71*e* toward the side near the top face 71*d*. The edge 71*a* defining the orifice 73 may form a wall surface, defining the hollow part, that extends flat between the bottom face 71*e* and the top face 71*d* or curved in an arc shape between the bottom face 71*e* and the top face 71*d*.

<Functional Effects of Outdoor Heat Exchanger 10>

In the liquid-header distributor 70 according to Embodiment 5, the edge 71*c* and the edge 71*a* each defining the orifice 73 become thinner toward the upper side of the liquid-header distributor 70. That is, in the liquid-header distributor 70 according to Embodiment 5, the opening size of the orifice 73 decreases toward the upper side of the liquid-header distributor 70.

In the liquid-header distributor 70 configured as above, the pressure loss that occurs when the refrigerant passes through the orifice 73 is reduced. Therefore, the flow rate of the refrigerant that passes through the orifice 73 is increased. Hence, in the outdoor heat exchanger 10, an increased amount of liquid refrigerant is caused to flow into those heat-transfer tubes 50 that are connected to an upper part of the liquid-header distributor 70. Thus, the performance of the heat exchanger is improved.

The air-conditioning apparatus 100 includes the outdoor heat exchanger 10 according to any of Embodiments 1 to 5 described above. Hence, the air-conditioning apparatus 100 produces the effects produced by any of the outdoor heat exchangers 10 according to Embodiments 1 to 5. Since the air-conditioning apparatus 100 includes the outdoor heat exchanger 10, the separation between the gas refrigerant and the liquid refrigerant contained in the two-phase gas-liquid refrigerant is prevented. Therefore, the gas refrigerant and the liquid refrigerant are evenly distributed to those heat-transfer tubes 50 that are located in a downstream part of the liquid-header distributor 70.

Embodiments 1 to 5 described above may be combined in any way. The features described in Embodiments 1 to 5 are merely examples of the present disclosure and may be combined with any of known techniques. Some of the features described above may be omitted or changed without departing from the essence of the present disclosure. For example, the liquid-header distributors 70 according to Embodiments 1 to 5 may each be vertically oriented such that the body 70*a* thereof extends in the vertical direction, or horizontally oriented such that the body 70*a* thereof extends in the horizontal direction. Furthermore, the body 70*a* of each of the liquid-header distributors 70 according to Embodiments 1 to 5 may be inclined relative to the vertical direction.

Figure 37:
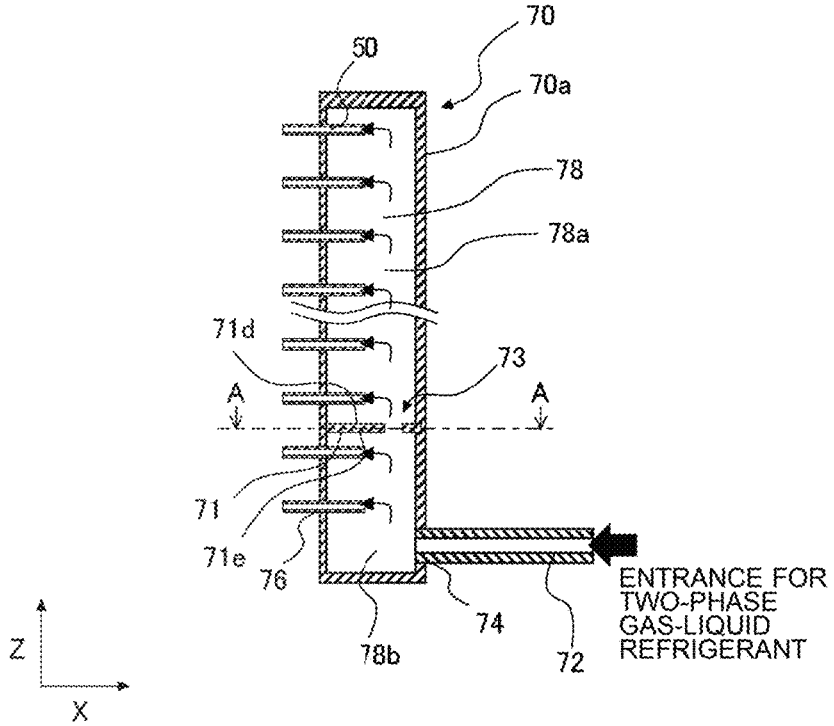
FIG. 37 outlines a modification of the liquid-header distributor.
Figure 38:
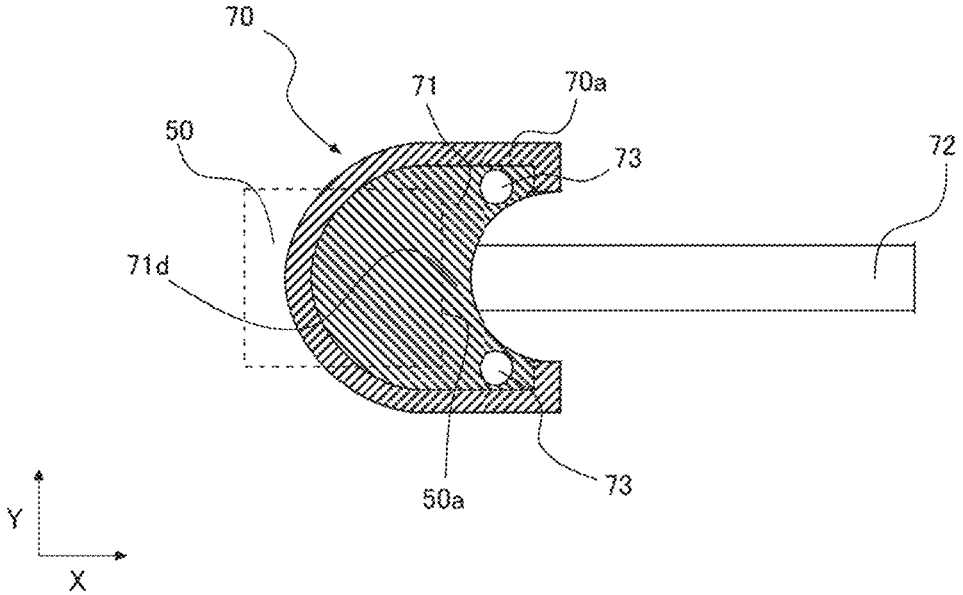
FIG. 38 illustrates a section of the liquid-header distributor illustrated in FIG. 37, taken along line A-A.
Figure 39:
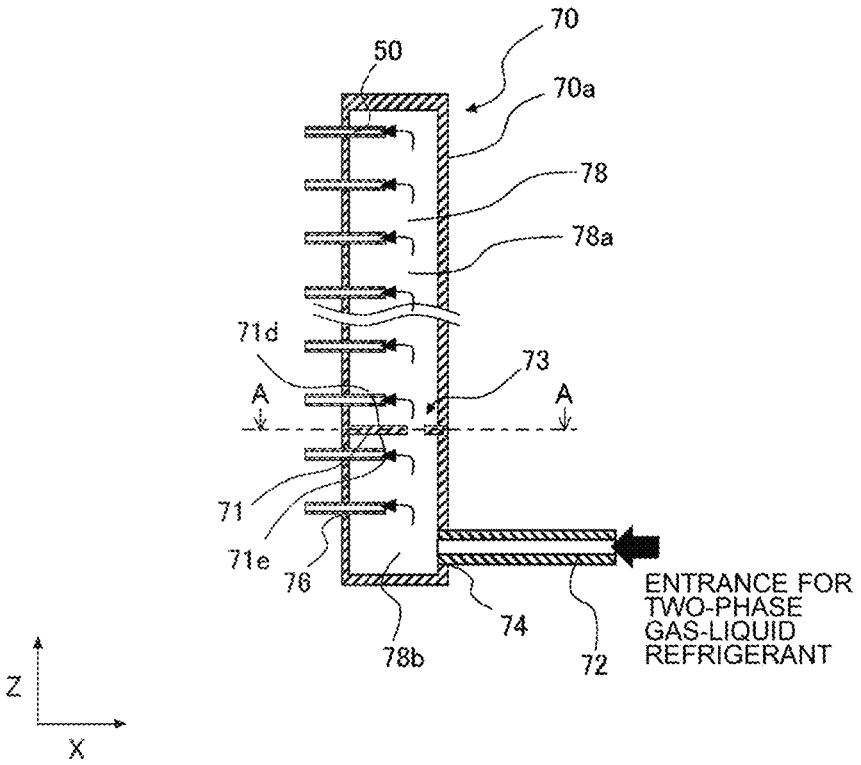
FIG. 39 outlines another modification of the liquid-header distributor.
Figure 40:
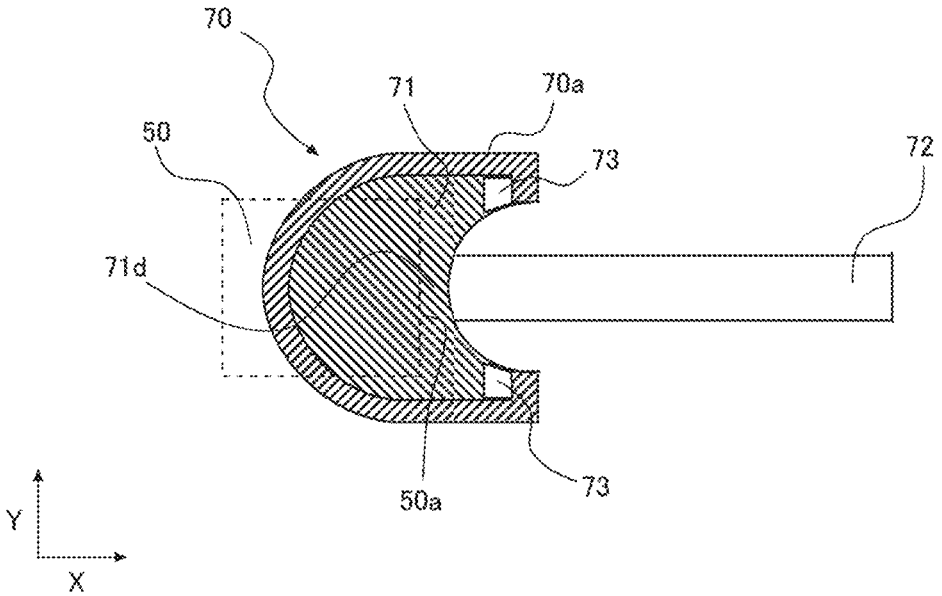
FIG. 40 illustrates a section of the liquid-header distributor illustrated in FIG. 39, taken along line A-A.

FIG. 37 outlines a modification of the liquid-header distributor 70. FIG. 38 illustrates a section of the liquid-header distributor 70 illustrated in FIG. 37, taken along line A-A. FIG. 39 outlines another modification of the liquid-header distributor 70. FIG. 40 illustrates a section of the liquid-header distributor 70 illustrated in FIG. 39, taken along line A-A. The body 70*a* is not limited to the one whose section perpendicular to the axial direction of the body 70*a* is circular and may have a section in a substantially U shape, as illustrated in FIGS. 37 to 40, or any other shape. Furthermore, the number of orifices 73 is not limited to one and may be two or more, as illustrated in FIGS. 37 to 40.

The outdoor heat exchanger 10 according to any of the above embodiments of the present disclosure is applicable not only to the above air-conditioning apparatus 100 but also to, for example, a heat-pump apparatus, a water heater, or a refrigerator.

REFERENCE SIGNS LIST

10: outdoor heat exchanger, 11: heat-exchanger core, 12: heat-transfer promoter, 30: indoor heat exchanger, 31: expansion device, 33: compressor, 34: flow switching device, 35: refrigerant pipe, 36: outdoor fan, 37: indoor fan, 50: heat-transfer tube, 50*a*: end, 60: gas-header distributor, 60*a*: body, 61: gas-header inflow/outflow pipe, 70: liquid header distributor, 70*a*: body, 70*b*: inner wall, 70*b*1: inner wall, 71: orifice plate, 71*a*: edge, 71*b*: edge, 71*c*: edge, 71*d*: top face, 71*e*: bottom face, 72: liquid-header inflow/outflow pipe, 73: orifice, 74: inlet, 75: projecting wall, 75*a*: projecting wall, 76: connection port, 78: internal space, 78*a*: top space, 78*b*: bottom space, 100: air-conditioning apparatus, 170: liquid-header distributor, D: pipe axis

The invention claimed is:

1. A heat exchanger comprising:

a distributor extending in a top-bottom direction in a form of a pipe and in which refrigerant flows;

a plurality of heat-transfer tubes connected to the distributor while being arranged at intervals from one another in the top-bottom direction, the heat-transfer tubes receiving the refrigerant flowing from the distributor; and a refrigerant inflow pipe connected to the distributor at a position below a lowest one of the plurality of heat-transfer tubes and through which the refrigerant flows into the distributor, wherein the plurality of heat-transfer tubes connected to the distributor stick out into an internal space of the distributor such that when the plurality of heat-transfer tubes and a part defined as the internal space are projected on a plane perpendicular to an axial direction of the distributor, the plurality of heat-transfer tubes occupies one-half or greater of the part defined as the internal space;

wherein the distributor includes an orifice plate being in a form of a plate and dividing the internal space into an upper space and a lower space in a longitudinal direction of the distributor;

wherein the orifice plate is located above the lowest one of the plurality of heat-transfer tubes in the internal space;

wherein the orifice plate has an orifice that is a through-hole through which the upper space and the lower space communicate with each other; and wherein the orifice plate is inclined downward toward a part of an inner wall surface of the distributor, the part being opposite a position of connection between the plurality of heat-transfer tubes and the distributor.

2. The heat exchanger of claim 1, wherein letting the number of heat-transfer tubes arranged in parallel with one another in the top-bottom direction be n, the orifice plate is located below an n/2-th one of the heat-transfer tubes counting from a bottom.

3. The heat exchanger of claim 1, wherein a part of an inner wall of the orifice is formed by an inner wall of the distributor.

4. The heat exchanger of claim 1, wherein the orifice is provided at such a position that when the orifice and the plurality of heat-transfer tubes are projected on a plane perpendicular to the axial direction of the distributor, one-half or greater of an area of the orifice does not coincide with the plurality of heat-transfer tubes.

5. The heat exchanger of claim 1, wherein the orifice is provided at such a position that when the orifice and the plurality of heat-transfer tubes are projected on a plane perpendicular to the axial direction of the distributor, the orifice does not coincide with the plurality of heat-transfer tubes.

6. The heat exchanger of claim 1, wherein when the orifice plate is seen in a section taken in the axial direction of the distributor, a top face of the orifice plate is inclined downward toward the orifice.

7. The heat exchanger of claim 1, wherein a top face of the orifice plate is recessed in an oblique circular conical shape at a deepest part of which the orifice is provided.

8. A heat exchanger comprising:

a distributor extending in a top-bottom direction in a form of a pipe and in which refrigerant flows;

a plurality of heat-transfer tubes connected to the distributor while being arranged at intervals from one another in the top-bottom direction, the heat-transfer tubes receiving the refrigerant flowing from the distributor; and a refrigerant inflow pipe connected to the distributor at a position below a lowest one of the plurality of heat-transfer tubes and through which the refrigerant flows into the distributor, wherein the plurality of heat-transfer tubes connected to the distributor stick out into an internal space of the distributor such that when the plurality of heat-transfer tubes and a part defined as the internal space are projected on a plane perpendicular to an axial direction of the distributor, the plurality of heat-transfer tubes occupies one-half or greater of the part defined as the internal space;

wherein the distributor includes an orifice plate being in a form of a plate and dividing the internal space into an upper space and a lower space in a longitudinal direction of the distributor;

wherein the orifice plate is located above the lowest one of the plurality of heat-transfer tubes in the internal space;

wherein the orifice plate has an orifice that is a through-hole through which the upper space and the lower space communicate with each other; and wherein the orifice plate includes a projecting wall provided at a peripheral edge of the orifice and projecting upward from a top face of the orifice plate.

9. A heat exchanger comprising:

a distributor extending in a top-bottom direction in a form of a pipe and in which refrigerant flows;

a plurality of heat-transfer tubes connected to the distributor while being arranged at intervals from one another in the top-bottom direction, the heat-transfer tubes receiving the refrigerant flowing from the distributor; and a refrigerant inflow pipe connected to the distributor at a position below a lowest one of the plurality of heat-transfer tubes and through which the refrigerant flows into the distributor, wherein the plurality of heat-transfer tubes connected to the distributor stick out into an internal space of the distributor such that when the plurality of heat-transfer tubes and a part defined as the internal space are projected on a plane perpendicular to an axial direction of the distributor, the plurality of heat-transfer tubes occupies one-half or greater of the part defined as the internal space;

wherein the distributor includes an orifice plate being in a form of a plate and dividing the internal space into an upper space and a lower space in a longitudinal direction of the distributor;

wherein the orifice plate is located above the lowest one of the plurality of heat-transfer tubes in the internal space;

wherein the orifice plate has an orifice that is a through-hole through which the upper space and the lower space communicate with each other; and wherein the orifice plate is shaped such that an opening size of the orifice decreases from a bottom face of the orifice plate toward a top face of the orifice plate.

10. The heat exchanger of claim 1, wherein the orifice provided in the orifice plate is one of two or more orifices.

11. An air-conditioning apparatus comprising:

the heat exchanger of claim 1, and a fan configured to supply air to the heat exchanger.

* * * * *